US009170542B2

(12) United States Patent
Hiratsuka et al.

(10) Patent No.: US 9,170,542 B2
(45) Date of Patent: Oct. 27, 2015

(54) IMAGE FORMING APPARATUS THAT TRANSFERS TONER IMAGE ONTO SHEET

(71) Applicant: CANON KABUSHIKI KAISHA, Tokyo (JP)

(72) Inventors: Takashi Hiratsuka, Kawasaki (JP); Yasumi Yoshida, Yokohama (JP); Takaaki Aoyagi, Kawasaki (JP); Takeshi Aoyama, Kawasaki (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/038,017

(22) Filed: Sep. 26, 2013

(65) Prior Publication Data

US 2014/0099135 A1 Apr. 10, 2014

(30) Foreign Application Priority Data

Oct. 4, 2012 (JP) ..... 2012-222204

(51) Int. Cl.
*G03G 15/16* (2006.01)
*G03G 15/01* (2006.01)
*G03G 15/00* (2006.01)

(52) U.S. Cl.
CPC ..... *G03G 15/5054* (2013.01); *G03G 15/1615* (2013.01); *G03G 2215/0016* (2013.01)

(58) Field of Classification Search
USPC ..... 399/36, 66, 165, 167, 302
See application file for complete search history.

(56) References Cited

U.S. PATENT DOCUMENTS

2008/0089706 A1* 4/2008 Nakazato et al. ..... 399/44
2009/0154964 A1* 6/2009 Tsuruya ..... 399/308

FOREIGN PATENT DOCUMENTS

JP 2004-037916 A 2/2004

OTHER PUBLICATIONS

JP2004-037916 Machine Translation available from JPO.*

* cited by examiner

*Primary Examiner* — Minh Phan
(74) *Attorney, Agent, or Firm* — Rossi, Kimms & McDowell LLP

(57) ABSTRACT

An image forming apparatus capable of accurately forming an image in a predetermined position on a sheet. An image forming unit forms a toner image on a drum. The toner image is transferred onto a belt. A motor drives the belt to convey the toner image to a transfer position where the toner image is transferred onto a sheet. An image position-detecting section detects that a patch image indicating the position of the toner image on the belt has reached a detection position upstream of the transfer position in an image conveying direction. A sheet position-detecting section detects that the leading edge of the sheet has reached a detection position upstream of the transfer position in a sheet conveying direction. An image speed-setting section controls the conveying speed of the belt based on timings of detection by the respective image position-detecting and sheet position-detecting sections.

9 Claims, 17 Drawing Sheets

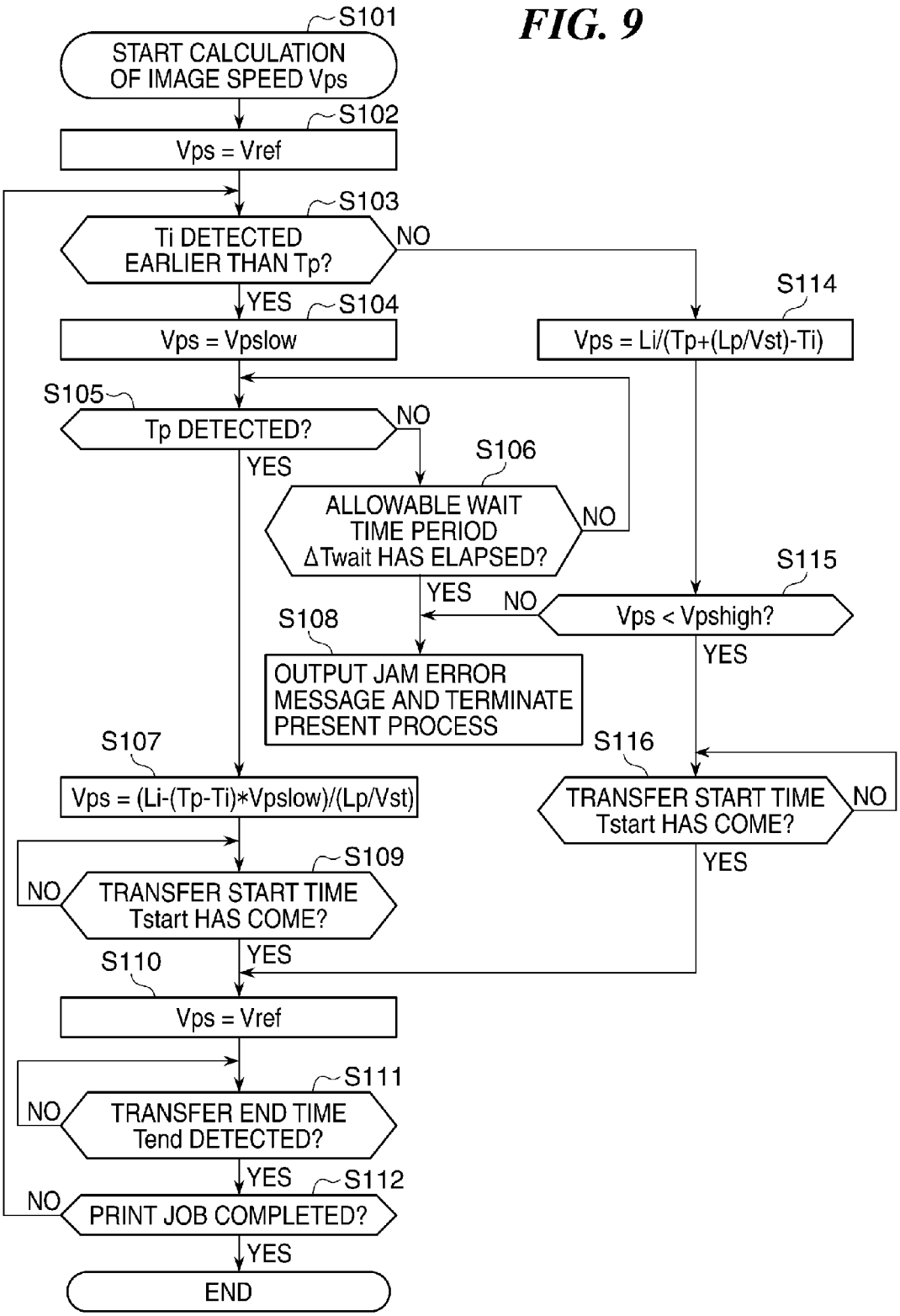
FIG. 9
S101
START CALCULATION OF IMAGE SPEED Vps
S102
Vps = Vref
S103
Ti DETECTED EARLIER THAN Tp?
NO
YES
S104
Vps = Vpslow
S114
Vps = Li/(Tp+(Lp/Vst)-Ti)
S105
Tp DETECTED?
NO
YES
S106
ALLOWABLE WAIT TIME PERIOD ΔTwait HAS ELAPSED?
NO
YES
S115
NO
Vps < Vpshigh?
YES
S108
OUTPUT JAM ERROR MESSAGE AND TERMINATE PRESENT PROCESS
S107
Vps = (Li-(Tp-Ti)*Vpslow)/(Lp/Vst)
S116
TRANSFER START TIME Tstart HAS COME?
NO
YES
S109
NO
TRANSFER START TIME Tstart HAS COME?
YES
S110
Vps = Vref
S111
NO
TRANSFER END TIME Tend DETECTED?
YES
S112
NO
PRINT JOB COMPLETED?
YES
END

IMAGE FORMING APPARATUS THAT TRANSFERS TONER IMAGE ONTO SHEET

BACKGROUND OF THE INVENTION

1. Field of the Invention

The present invention relates to an image forming apparatus configured to transfer a toner image formed on an image bearing member onto a sheet.

2. Description of the Related Art

Conventionally, there has been known an image forming apparatus that transfers a toner image formed on an image bearing member, such as a photosensitive drum, through exposure and development, onto an intermediate transfer member, such as an intermediate transfer belt, and then transfers the toner image formed on the intermediate transfer member onto a sheet. In a full-color image forming apparatus, for example, toner images of respective color components formed on image bearing members, respectively, are transferred in a superimposed manner onto an intermediate transfer member at a first transfer position, and then the full-color toner image on the intermediate transfer member is transferred onto a sheet at a second transfer position.

In order that the image forming apparatus configured as above can form a high-quality image, it is required to transfer a toner image (image) onto a predetermined position on a sheet. For this reason, it is demanded that timing at which a conveyed sheet reaches a transfer position and timing at which a toner image on the intermediate transfer member reaches the second transfer position accurately coincide with each other.

However, variation in the accuracy of stacking of sheets and deformation or aging of mechanism components arranged in a conveying path along which sheets are conveyed can cause a difference between the above-mentioned timings. If an image cannot be accurately transferred onto a predetermined position on a sheet due to this difference between the timings, the quality of the image is degraded.

To solve this problem, there has been proposed an image forming apparatus which is capable of adjusting the timing at which a conveyed sheet reaches a transfer position (see Japanese Patent Laid-Open Publication No. 2004-37916). In this image forming apparatus, the timing at which a toner image on an intermediate transfer belt reaches the transfer position is adjusted by controlling the conveying speed of the intermediate transfer belt.

However, the configuration disclosed in Japanese Patent Laid-Open Publication No. 2004-37916 can cause other kinds of problems concerning image quality (image expansion or contraction and color misregistration).

First, since the conveying speed of the intermediate transfer member, such as an intermediate transfer belt, is variable, a toner image transferred from an image bearing member onto the intermediate transfer member can be expanded or contracted.

Further, in an image forming apparatus which has a plurality of image bearing members associated with respective colors, such as Y (yellow), M (magenta), C (cyan), and K (black), when the conveying speed of the intermediate transfer member changes during transfer of toner images on the respective image bearing members onto the intermediate transfer member, displacement occurs between the respective positions of color-component toner images on the intermediate transfer member. Consequently, there is a fear that the color hue of an image formed on a sheet cannot be obtained as desired.

SUMMARY OF THE INVENTION

The present invention provides an image forming apparatus which is capable of forming an image in a predetermined position on a sheet with high accuracy.

In a first aspect of the present invention, there is provided an image forming apparatus comprising an image bearing member, an image forming unit configured to form a toner image on the image bearing member, an intermediate transfer member onto which the toner image formed on the image bearing member by the image forming unit is transferred, a driving unit configured to drive the intermediate transfer member to convey the toner image transferred onto the intermediate transfer member, a transfer unit configured to transfer the toner image on the intermediate transfer member, which has been conveyed to a transfer position by the driving unit, onto a sheet, a conveying unit configured to convey the sheet to the transfer position, a first detection unit configured to detect an image indicating a position of the toner image on the intermediate transfer member, a second detection unit configured to detect that the sheet conveyed by the conveying unit has reached a detection position upstream of the transfer position in a direction in which the sheet is conveyed by the conveying unit, and a control unit configured to control a conveying speed of the intermediate transfer member, based on timing of detection by the first detection unit and timing of detection by the second detection unit, such that the toner image on the intermediate transfer member is transferred by the transfer unit onto a predetermined position on the sheet conveyed by the conveying unit.

In a second aspect of the present invention, there is provided an image forming apparatus comprising an image bearing member, a first driving unit configure to rotate the image bearing member, an image forming unit configured to form a toner image on the image bearing member, an intermediate transfer member onto which the toner image formed on the image bearing member by the image forming unit is transferred, a second driving unit configured to drive the intermediate transfer member, a transfer unit configured to transfer the toner image on the intermediate transfer member onto a sheet at a transfer position, a conveying unit configured to convey the sheet to the transfer position, a first detection unit configured to detect an image indicating a position of the toner image on the intermediate transfer member, a second detection unit configured to detect that the sheet conveyed by the conveying unit has reached a detection position upstream of the transfer position in a direction in which a sheet is conveyed by the conveying unit, a determination unit configured to determine, based on timing of detection by the first detection unit and timing of detection by the second detection unit, the conveying speed of the intermediate transfer member, and a control unit configured to control the first driving unit and the second driving unit such that the conveying speed of the intermediate transfer member during a time period from a time point when the image is detected by the first detection unit to a time point when the sheet conveyed by the conveying unit reaches the transfer position becomes equal to the conveying speed determined by the determination unit.

According to the present invention, it is possible to form an image in a predetermined position on a sheet with high accuracy.

Further features of the present invention will become apparent from the following description of exemplary embodiments with reference to the attached drawings.

BRIEF DESCRIPTION OF THE DRAWINGS

FIG. 9 is a flowchart of an image speed-setting process for setting an image speed.

DESCRIPTION OF THE EMBODIMENTS

The present invention will now be described in detail below with reference to the accompanying drawings showing embodiments thereof.

In the following description, terms used in appended claims are parenthesized. These parenthesized terms are added only for ease of understanding, and are by no means intended to limit elements represented by the terms to corresponding components in the embodiments.

Figure 1:
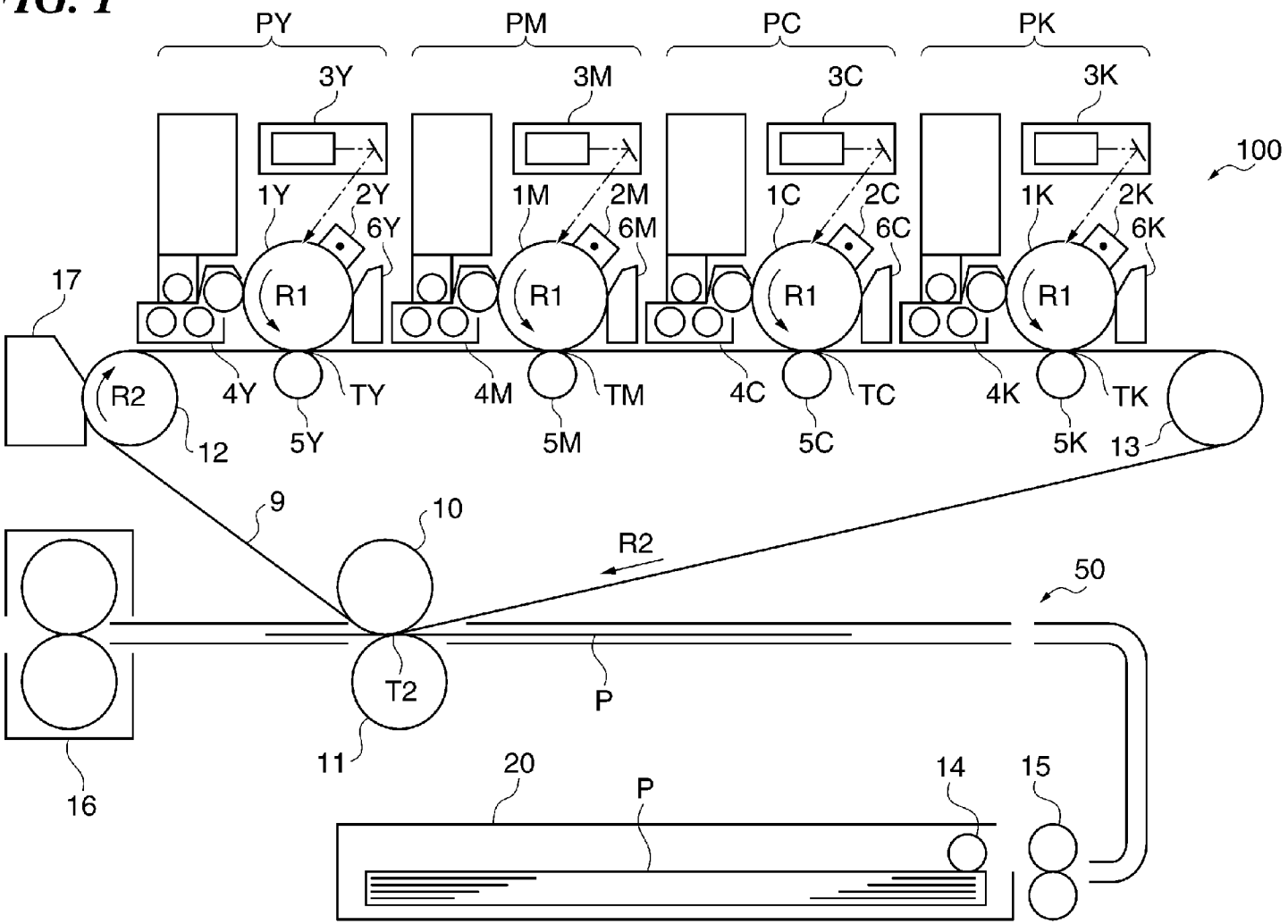
FIG. 1 is a view of an image forming apparatus according to a first embodiment of the present invention.

FIG. 1 is a view of an image forming apparatus according to a first embodiment of the present invention.

First, a description will be given of the basic configuration and operation of the image forming apparatus 100 according to the present embodiment. Although the image forming apparatus 100 is configured as a full-color image forming apparatus, this is not limitative, but the image forming apparatus 100 may be a monochrome or mono-color image forming apparatus.

The image forming apparatus 100 includes a plurality of image forming units PY, PM, PC, and PK associated with respective four colors, yellow (Y), magenta (M), cyan (C), and black (K) arranged along an intermediate transfer belt 9 as an intermediate transfer member. Hereafter, when it is required to distinguish a component element of one of the image forming units PY, PM, PC, and PK from corresponding ones of the other image forming units, Y, M, C, or K will be added to a reference numeral that denotes the component element.

The image forming unit PY forms a yellow toner image on a photosensitive drum 1Y which is an image bearing member. The toner image formed on the photosensitive drum 1Y is conveyed to a transfer position TY by the photosensitive drum 1Y that rotates in a direction indicated by an arrow R1. At the transfer position TY, the toner image on the photosensitive drum 1Y is transferred onto the intermediate transfer belt 9 by a transfer roller 5Y.

The image forming unit PM forms a magenta toner image on a photosensitive drum 1M. The toner image formed on the photosensitive drum 1M is conveyed to a transfer position TM by the photosensitive drum 1M that rotates in the direction indicated by the arrow R1. At the transfer position TM, the toner image on the photosensitive drum 1M is transferred onto the intermediate transfer belt 9 by a transfer roller 5M. The transfer position TM is located downstream of the transfer position TY in a direction of movement of the intermediate transfer belt 9.

The image forming unit PC forms a cyan toner image on a photosensitive drum 1C. The toner image formed on the photosensitive drum 1C is conveyed to a transfer position TC by the photosensitive drum 1C that rotates in the direction indicated by the arrow R1. At the transfer position TC, the toner image on the photosensitive drum 1C is transferred onto the intermediate transfer belt 9 by a transfer roller 5C. The transfer position TC is located downstream of the transfer position TM in the direction of movement of the intermediate transfer belt 9.

The image forming unit PK forms a black toner image on a photosensitive drum 1K. The toner image formed on the photosensitive drum 1K is conveyed to a transfer position TK by the photosensitive drum 1K that rotates in the direction indicated by the arrow R1. At the transfer position TK, the toner image on the photosensitive drum 1K is transferred onto the intermediate transfer belt 9 by a transfer roller 5K. The transfer position TK is located downstream of the transfer position TC in the direction of movement of the intermediate transfer belt 9.

The intermediate transfer belt 9 is supported by a driving roller 12, a tension roller 13, and a backup roller 10. The driving roller 12 is rotated by a motor MBLT (second driving unit) (see FIG. 3). For example, a gear is provided between the motor MBLT and the driving roller 12 to reduce the speed of rotation of the motor MBLT. Rotation of the driving roller 12 causes the intermediate transfer belt 9 to rotate in a direction indicated by an arrow R2 in FIG. 1.

A transfer roller 11 is disposed on an opposite side of the intermediate transfer belt 9 from the backup roller 10. The intermediate transfer belt 9 is sandwiched between the backup roller 10 and the transfer roller 11. In timing at which a toner image carried by the intermediate transfer belt 9 passes a transfer position T2, transfer voltage is applied to the transfer roller 11. This causes the toner image on the intermediate transfer belt 9 to be transferred onto a sheet P conveyed to the transfer position T2.

Note that the image forming apparatus 100 has a conveying unit 50 for conveying sheets to the transfer position T2. The conveying unit 50 includes a plurality of conveying rollers. Sheets P are drawn out from a sheet feed cassette 20 by a sheet feed roller 14, and are then separated one from another by a separation unit 15. A sheet P fed from the sheet feed cassette 20 is conveyed to the transfer position T2 via a conveying path. It is assumed that the conveying unit 50 conveys the sheet P at a fixed conveying speed (sheet conveying speed Vst).

The sheet P having a toner image transferred thereon is passed to a fixing device 16. The fixing device 16 fixes the image onto the sheet P by heating and pressing the sheet P.

A belt cleaner 17 removes toner remaining on a portion, which has passed the transfer position T2, of the intermediate transfer belt 9, using a rubber blade, not shown.

The image forming units PY, PM, PC, and PK are basically identical in arrangement to each other except that colors of toner used by the respective developing units 4Y, 4M, 4C, and 4K are different, i.e. yellow, magenta, cyan, and black, respectively. Therefore, to describe the operation and arrangement of the image forming units P, the following description is given only of the operation and arrangement of the image forming unit PY, and the description of those of the other image forming units PM, PC, and PK is omitted.

Figure 2:
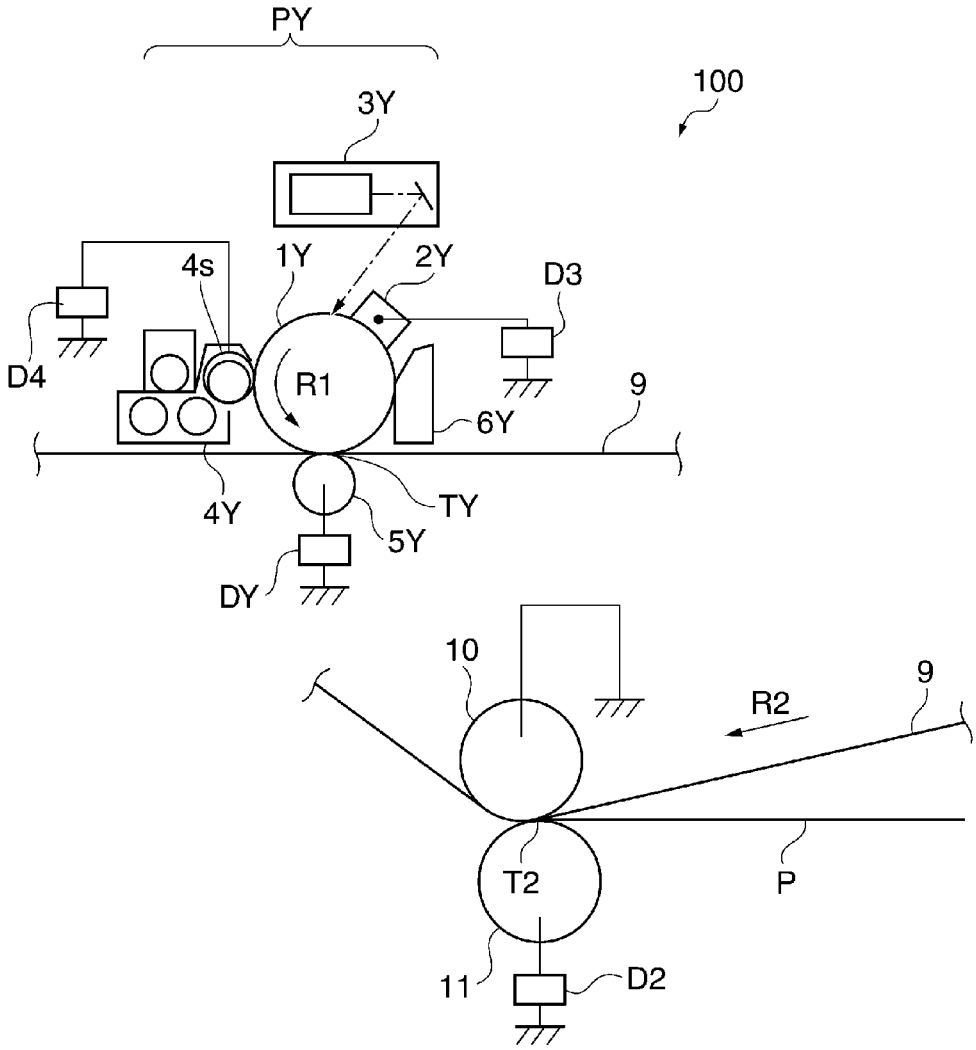
FIG. 2 is a schematic view of a transfer unit.

FIG. 2 is a schematic view of a transfer unit of the image forming apparatus 100.

As shown in FIG. 2, the image forming unit PY has a charging unit 2Y, an exposure unit 3Y, the developing unit 4Y, the transfer roller 5Y, and a drum cleaner 6Y, arranged around the photosensitive drum 1Y. The photosensitive drum 1Y is formed by providing an organic photoconductor (OPC) layer having a negative charging polarity on the outer peripheral surface of an aluminum cylinder. The photosensitive drum 1Y is rotated by a motor, not shown, in the direction indicated by the arrow R1.

The charging unit 2Y discharges in accordance with application of a voltage having a negative polarity thereto from a power supply D3, to thereby uniformly charge the surface of the photosensitive drum 1Y to a negative potential. The exposure unit 3Y exposes the photosensitive drum 1Y based on image data of a yellow component, whereby an electrostatic latent image is formed on the photosensitive drum 1Y.

The developing unit 4Y stirs a two-component developer which is a mixture of toner and magnetic carrier to thereby charge the toner to a negative polarity. The charged toner, carried on a rotating developing sleeve 4*s*, is supplied to the photosensitive drum 1Y. A power supply D4 applies a developing voltage obtained by superimposing an AC voltage on a DC voltage having a negative polarity to the developing sleeve 4*s* to thereby cause the toner to be attached to an electrostatic latent image on the photosensitive drum 1Y whose polarity has become positive relative to the developing sleeve 4*s*. The developing unit 4Y forms a toner image on the photosensitive drum 1Y by thus developing the electrostatic latent image formed on the photosensitive drum 1Y.

The transfer roller 5Y cooperates with the photosensitive drum 1Y to nip the intermediate transfer belt 9 therebetween, whereby the transfer position TY is defined between the photosensitive drum 1Y and the intermediate transfer belt 9. A power supply DY applies a DC voltage having a positive polarity to the transfer roller 5Y, whereby the toner image charged to a negative polarity on the photosensitive drum 1Y is transferred onto the intermediate transfer belt 9 at the transfer position TY. The drum cleaner 6Y causes a cleaning blade to slidingly rub the photosensitive drum 1Y, thereby removing toner remaining on a portion, which has passed the transfer position TY, of the surface of the photosensitive drum 1Y.

The transfer roller 11 presses the backup roller 10 via the intermediate transfer belt 9. The transfer position T2 is defined between the intermediate transfer belt 9 and the transfer roller 11. The toner image is transferred from the intermediate transfer belt 9 onto the sheet P during a process in which the toner image on the intermediate transfer belt 9 and the sheet P pass the transfer position T2.

A power supply D2 applies a positive DC voltage to the transfer roller 11 so as to cause the toner image to be transferred from the intermediate transfer belt 9 onto the sheet P.

Note that the image forming apparatus 100 according to the present embodiment is configured to be capable of changing the conveying speed of the intermediate transfer belt 9. A reference value (reference speed Vref) of the conveying speed of the intermediate transfer belt 9 is set to 200 mm/s, and it is possible to increase or decrease the conveying speed by 55% of the reference speed Vref. The range of speed increase or decrease has been determined, based on empirical data, as a range within which image quality is not adversely affected and also the advantageous effects of the present invention can be maximally obtained.

When the conveying speed of the intermediate transfer belt 9 is changed, the respective voltages applied to the charging unit 2Y, the developing unit 4Y, the transfer roller 5Y, and the transfer roller 11 are changed. Further, insofar as the developing unit 4Y is concerned, the circumferential speed of the developing sleeve is controlled such that a ratio between the circumferential speed of the developing sleeve and that of the photosensitive drum 1Y becomes equal to a predetermined value. With this control, the developing unit 4Y maintains density, transfer efficiency, etc. to thereby prevent degradation of image quality. The above-mentioned control operations are performed by a control section 110 (see FIG. 3), described hereinafter. The control section 110 controls the exposure unit 3Y and the photosensitive drum 1Y as well, which will be described hereinafter.

Figure 3:
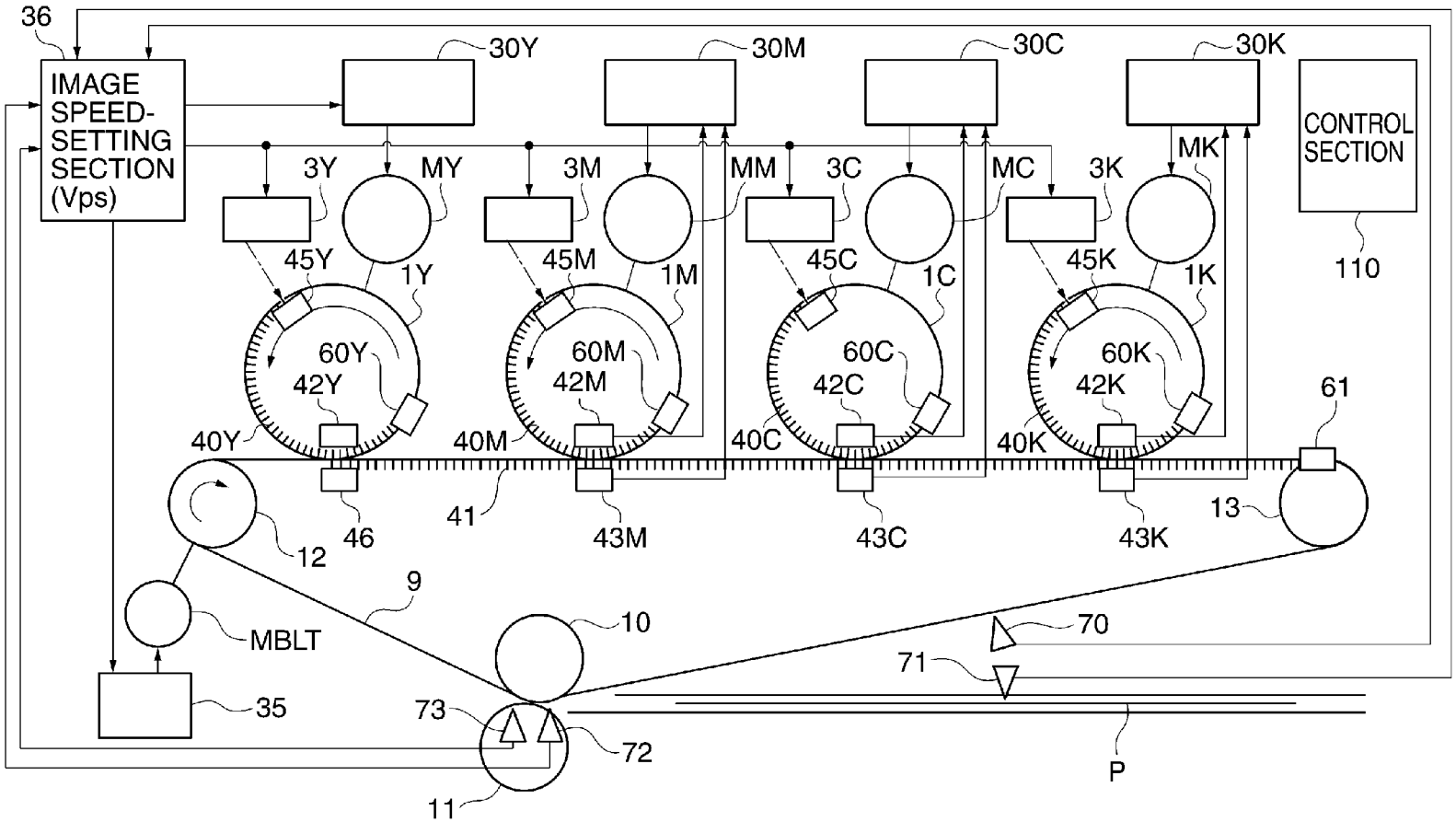
FIG. 3 is a control block diagram showing a configuration mainly concerning control of photosensitive drums, an intermediate transfer belt, and exposure units of the image forming apparatus.

FIG. 3 is a control block diagram showing a configuration mainly concerning control of the photosensitive drums 1Y, 1M, 1C, and 1K, the intermediate transfer belt 9, and the exposure units 3Y, 3M, 3C, and 3K of the image forming apparatus 100.

A motor MY drivingly rotates the photosensitive drum 1Y according to a command received from a drum drive control section 30Y. A motor MM drivingly rotates the photosensitive drum 1M according to a command received from a drum drive control section 30M. A motor MC drivingly rotates the photosensitive drum 1C according to a command received from a drum drive control section 30C. A motor MK drivingly rotates the photosensitive drum 1K according to a command received from a drum drive control section 30K.

The motor MBLT drivingly rotates the driving roller 12 according to a command received from a belt drive control section 35. The intermediate transfer belt 9 is driven according to the rotational speed of the driving roller 12.

The exposure units 3Y, 3M, 3C, and 3K each correct laser emission timing and a laser emission time period and also adjust the rotational speed of a polygon mirror, not shown, that deflects light emitted from a laser, not shown, based on an image speed Vps set by an image speed-setting section 36.

In the following description, timing at which a sheet P conveyed by the conveying unit 50 reaches the transfer position T2 will be referred to as "the first timing". Further, timing at which a toner image conveyed by the intermediate transfer belt 9 reaches the transfer position T2 will be referred to as "the second timing".

An image position-detecting section 70 (first detection unit) detects that a patch image indicating the position of a toner image formed on the intermediate transfer belt 9 has reached a predetermined position. In the present embodiment, the image forming unit PK forms the patch image on the intermediate transfer belt 9 so as to enable detection (determination) of the position of the toner image on the intermediate transfer belt 9. Each of a sheet position-detecting section 71 (second detection unit), a transfer start-detecting section 72, and a transfer end-detecting section 73 detects that the sheet P conveyed by the conveying unit 50 has reached a detection position associated with a sensor, not shown, of the detecting section.

The position of the toner image (image position) on the intermediate transfer belt 9 and a sheet position are determined from the result of detection by the image position-detecting section 70, and the results of detections by the sheet position-detecting section 71, the transfer start-detecting section 72, and the transfer end-detecting section 73. Based on the image position and sheet position thus determined, the image speed-setting section 36 predicts the first timing and the second timing.

Then, based on a difference between the predicted first timing and second timing, the image speed-setting section 36 calculates an appropriate target conveying speed which makes it possible to reduce the difference to zero, and sets an image speed Vps. Thereafter, the image speed-setting section 36 outputs the set image speed Vps to the drum drive control sections 30Y, 30M, 30C, and 30K, the belt drive control section 35, and the exposure units 3Y, 3M, 3C, and 3K.

Further, the respective voltages to be applied to the charging units 2Y, 2M, 2C, and 2K, the developing units 4Y, 4M, 4C, and 4K, the transfer rollers 5Y, 5M, 5C, and 5K, and the transfer roller 11 are changed based on the set image speed Vps.

The image forming apparatus 100 includes the control section 110. The detection results from the respective detecting sections are supplied to the control section 110. The control section 110 includes a CPU, not shown, and controls the overall operation of the image forming apparatus 100. More specifically, the control section 110 controls the image speed-setting section 36, the belt drive control section 35, the drum drive control section 30, the image forming units PY, PM, PC, and PK, the power supplies DY, DM, DC, DK, D2, D3, and D4, and so forth. The method of setting the image speed Vps will be described in detail hereinafter.

Each of the photosensitive drums 1Y, 1M, 1C, and 1K has a magnetic recording layer (not shown) formed on an inner peripheral surface thereof. It is desirable that the magnetic recording layer of each of the photosensitive drums 1Y, 1M, 1C, and 1K is formed by applying an information recording medium, such as a magnetic material, thereto at a location outside an image forming area of the photosensitive drum 1. For example, it is only required that a magnetic recording layer is formed in a non-image forming area of each of the photosensitive drums 1Y, 1M, 1C, and 1K. Each of the magnetic recording layers has marks formed thereon by an associated one of mark forming devices 45Y, 45M, 45C, and 45K, described hereinafter.

On the inner peripheral surfaces of the respective photosensitive drums 1Y, 1M, 1C, and 1K, there are disposed the mark forming devices 45Y, 45M, 45C, and 45K, respectively. Each of the mark forming devices 45Y, 45M, 45C, and 45K forms a mark 40Y, 40M, 40C, or 40K on the associated magnetic recording layer whenever the associated one of the exposure units 3Y, 3M, 3C, and 3K scans the associated photosensitive drum 1Y, 1M, 1C, or 1K. More specifically, the mark 40Y, 40M, 40C, or 40K is written on the inner peripheral surface of the associated photosensitive drum 1Y, 1M, 1C, or 1K at the same intervals as those of scanning lines. The marks 40Y, 40M, 40C, and 40K are each formed at sequential locations at the aforementioned intervals in the direction of rotation of the associated one of the photosensitive drums 1Y, 1M, 1C, and 1K.

Further, on the inner peripheral surfaces of the respective photosensitive drums 1Y, 1M, 1C, and 1K, there are disposed mark reading devices 42Y, 42M, 42C, and 42K in the vicinity of the respective transfer positions TY, TM, TC, and TK (see FIG. 1). On the other hand, a magnetic recording layer (not shown) is formed on an opposite surface of the intermediate transfer belt 9 from the surface thereof for carrying a toner image.

A mark forming device 46 is disposed on an opposite side of the intermediate transfer belt 9 from the mark reading device 42Y. The mark forming device 46 forms a mark 41 on the magnetic recording layer of the intermediate transfer belt 9 whenever the mark reading device 42Y reads a mark 40Y. More specifically, whenever a mark 40Y on the photosensitive drum 1Y is detected by the mark reading device 42Y, the mark forming device 46 forms a mark 41 on the intermediate transfer belt 9.

Further, at respective locations on the opposite side of the intermediate transfer belt 9 from the mark reading devices 42M, 42C, and 42K, there are disposed mark reading devices 43M, 43C, and 43K for reading marks 41 formed on the intermediate transfer belt 9.

Now, by paying attention to transfer at the transfer position TM, let it be assumed that simultaneously when the mark reading device 43M reads a mark 41, the mark reading device 42M reads a mark 40M. This means that a scanning line formed on the photosensitive drum 1M has been superimposed on a scanning line carried on the intermediate transfer belt 9.

Actually, however, the intermediate transfer belt 9 does not rotate at a fixed speed, i.e. there is variation in the rotation (rotational speed) of the intermediate transfer belt 9. Further, the mark 40Y and hence in turn the mark 41 cannot necessarily be always formed at equal intervals due to variation in the rotation of the photosensitive drum 1Y. For this reason, a difference in timing occurs between the mark 41 and the mark 40M. This also occurs between the mark 41 and each of the marks 40C and 40K.

To solve this problem, each of the drum drive control sections 30M, 30C, and 30K controls the associated one of the motors MM, MC, and MK such that the associated mark 40M, 40C, or 40K matches the mark 41.

This causes the rotational phase of the photosensitive drum 1Y to match the respective rotational phases of the photosensitive drums 1M, 1C, and 1K, so that a difference between a pitch between scanning lines formed on the photosensitive drum 1Y by the exposure unit 3Y and a pitch between scanning lines formed on each of the photosensitive drums 1M, 1C, and 1K by the associated exposure unit 3M, 3C, or 3K is suppressed. Further, the photosensitive drums 1Y, 1M, 1C, and 1K are caused to match in rotational phase irrespective of variation in the conveying speed of the intermediate transfer belt 9. Therefore, even when images formed on the respective photosensitive drums 1Y, 1M, 1C, and 1K are transferred onto the intermediate transfer belt 9, it is possible to suppress expansion or contraction of the images and occurrence of color misregistration.

On the inner peripheral surface of each of the photosensitive drums 1Y, 1M, 1C, and 1K, there is disposed an associated one of erasing devices 60Y, 60M, 60C, and 60K at a location downstream of the associated mark reading device 42 in the direction of rotation of the photosensitive drum 1. Each of the erasing devices 60Y, 60M, 60C, and 60K erases marks 40 magnetically recorded on the associated one of the photosensitive drums 1Y, 1M, 1C, and 1K. On the opposite surface of the intermediate transfer belt 9 from the surface of the same that carries a toner image, there is disposed an erasing device 61 at a location downstream of the transfer position TK. The erasing device 61 erases marks 41 magnetically recorded on the intermediate transfer belt 9.

Figure 4A:
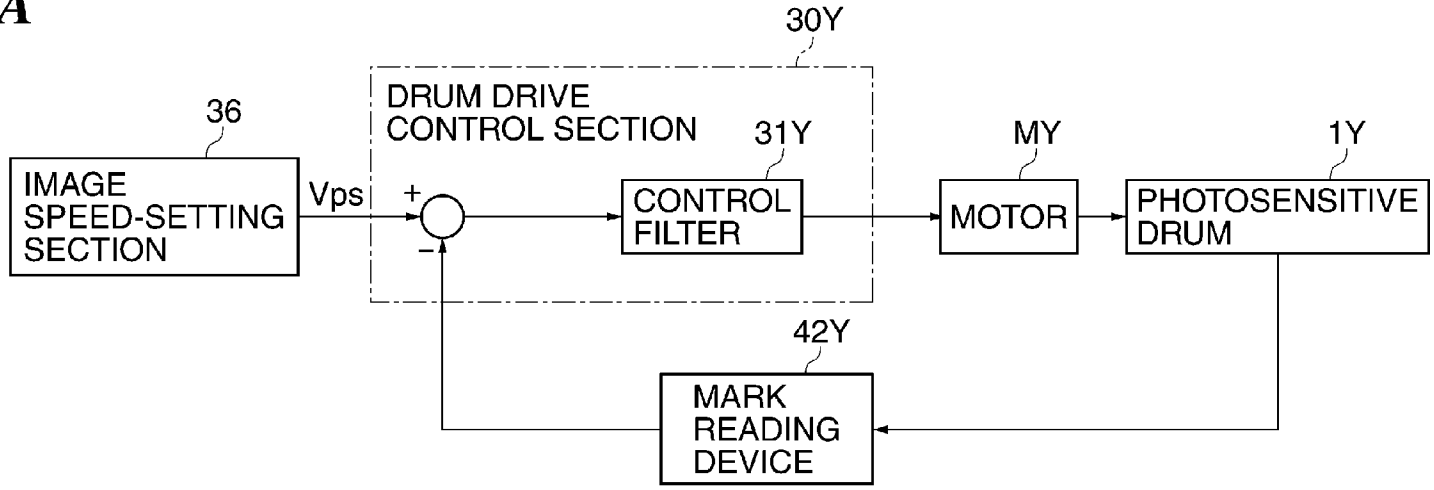
FIGS. 4A and 4B are control block diagrams of control units associated with respective drum driving sections.
Figure 4B:
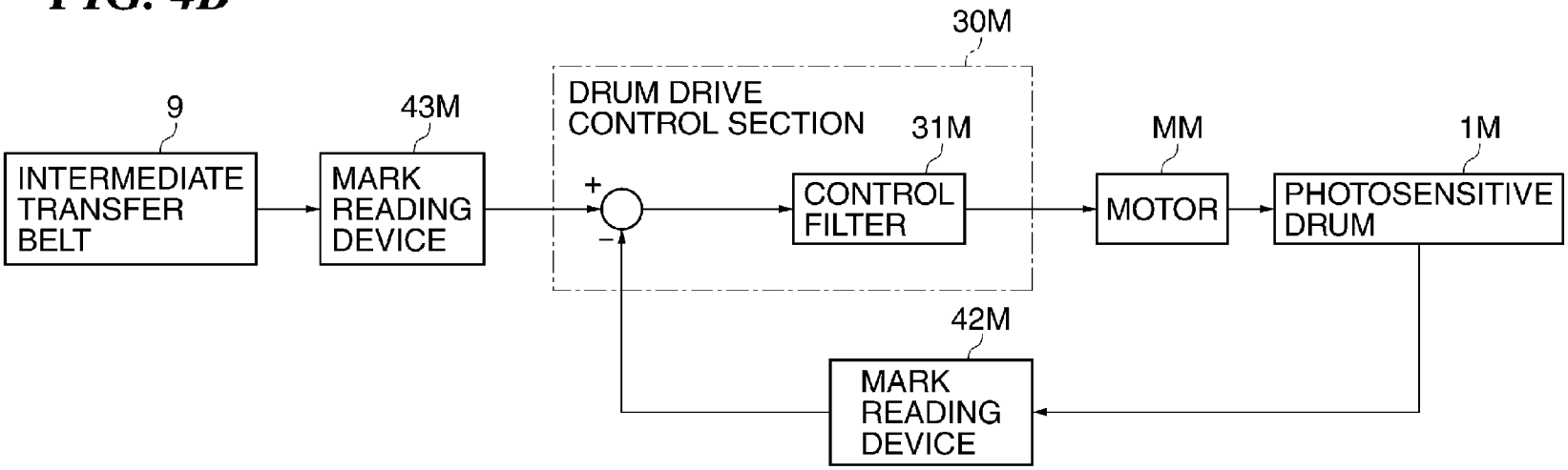

FIG. 4A is a control block diagram of the drum drive control section 30Y. FIG. 4B is a control block diagram of the drum drive control section 30M. The arrangement of each of the drum drive control sections 30C and 30K is the same as that of the drum drive control section 30M (see FIG. 4B), and therefore description thereof is omitted.

As shown in FIG. 4A, the drum drive control section 30Y measures detection (time) intervals at which the marks 40Y are detected by the mark reading device 42Y, to thereby calculate the circumferential speed of the photosensitive drum 1Y. The drum drive control section 30Y further determines a difference between the image speed Vps set by the image speed-setting section 36 and the circumferential speed of the photosensitive drum 1Y.

The drum drive control section 30Y inputs the difference between the circumferential speed of the photosensitive drum 1Y and the image speed Vps to a control filter 31Y, and controls the motor MY based on an output from the control filter 31Y. The drum drive control section 30Y thus performs feedback control of driving of the motor MY such that the circumferential speed of the photosensitive drum 1Y becomes equal to the image speed Vps.

This makes it possible, even when the conveying speed of the intermediate transfer belt 9 cannot be held constant, to suppress expansion or contraction of a toner image transferred from the photosensitive drum 1Y onto the intermediate transfer belt 9.

Note that the drum drive control section 30Y may be controlled according to a PID algorithm or another algorithm.

As shown in FIG. 4B, the drum drive control section 30M determines a difference between timing at which the mark reading device 43M detects a mark 41 and timing at which the mark reading device 42M detects a mark 40. The drum drive control section 30M inputs the difference in timing to a control filter 31M, and controls the motor MM based on an output from the control filter 31M.

The drum drive control section 30M performs feedback control of driving of the motor MM such that the circumferential speed of the photosensitive drum 1M becomes equal to the image speed Vps. This makes it possible, even when the conveying speed of the intermediate transfer belt 9 cannot be held constant, to suppress not only expansion or contraction of a toner image transferred from the photosensitive drum 1M onto the intermediate transfer belt 9, but also positional deviation of the magenta-component toner image with respect to the yellow-component toner image.

Further, similar to the image forming unit PM, the same control is executed on each of the image forming units PC and PK, whereby positional deviation of each of the cyan-component and black-component toner images with respect to the yellow-component toner image can be suppressed, which makes it possible to prevent variation of the color hue of the full-color image.

Note that the drum drive control section 30M may be controlled according to the PID algorithm or another algorithm.

By the way, the exposure unit 3M forms an electrostatic latent image in timing independent of the circumferential speed of the photosensitive drum 1M. Therefore, execution of the above-described control of the rotation of the photosensitive drum 1M causes variation in scanning line pitch.

To solve this problem, a parameter (amplification factor) is determined by the control filter 31M such that timing at which a mark 40M is detected matches timing at which a mark 41 is detected and also variation in scanning line pitch on the photosensitive drum 1M is suppressed.

Figure 5:
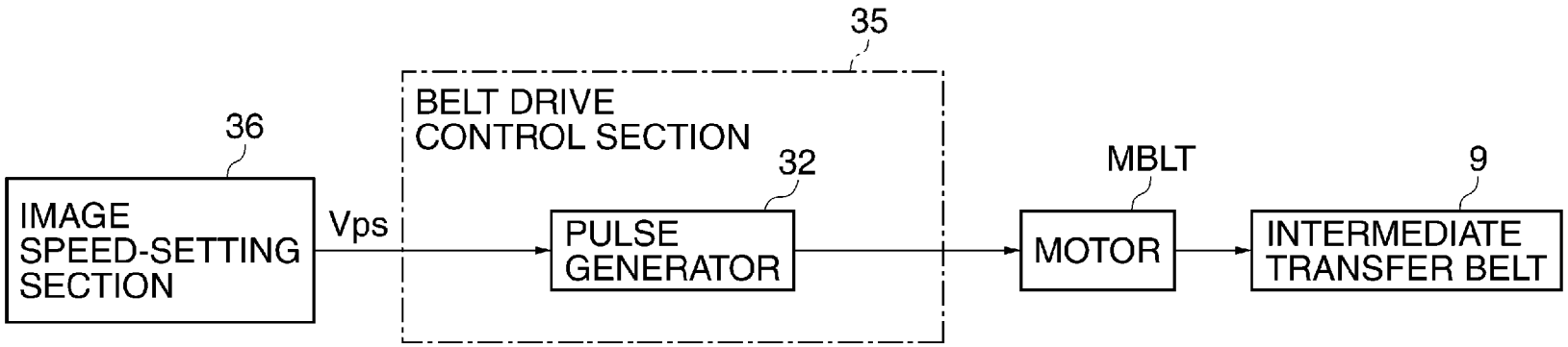
FIG. 5 is a control block diagram of a control unit associated with a belt driving section.

FIG. 5 is a control block diagram of the belt drive control section 35.

The belt drive control section 35 generates a pulse signal using a pulse generator 32 incorporated therein, based on the image speed Vps set by the image speed-setting section 36. The belt drive control section 35 drives the motor MBLT based on the pulse signal generated by the pulse generator 32.

This causes the conveying speed of the intermediate transfer belt 9 to be controlled based on the image speed Vps.

In the example shown in FIG. 5, the belt drive control section 35 does not perform feedback control of driving of the motor MBLT, but performs open-loop control of the same based on the image speed Vps. However, the belt drive control section 35 may be configured to perform feedback control of driving of the motor MBLT e.g. based on a difference between a measured value of the conveying speed of the intermediate transfer belt 9 and the image speed Vps.

With the control configuration described above with reference to FIGS. 3 to 5, the speed of the intermediate transfer belt 9 is changed without changing the sheet conveying speed, which makes it possible to suppress expansion or contraction of a toner image formed on the intermediate transfer belt 9 to thereby form a high-quality image with reduced color misregistration.

Summarized description of the operations of the above-described control by the control section 110 of the image forming apparatus 100, given in an approximate order of execution thereof, is as follows: First, driving of each of the exposure units 3Y, 3M, 3C, and 3K, the photosensitive drum 1Y, and the intermediate transfer belt 9 is controlled based on the image speed Vps set by the image speed-setting section 36.

Next, the photosensitive drums 1M, 1C, and 1K are driven such that intervals (scanning line pitch) at which light emitted from the exposure unit 3Y scans the photosensitive drum 1Y and intervals (scanning line pitch) at which light emitted from each of the exposure units 3M, 3C, and 3K scans the associated one of the photosensitive drums 1M, 1C, and 1K match each other. This controls transfer timing associated with each of the photosensitive drums 1M, 1C, and 1K. To superimpose toner images of the respective four colors, control is performed using the marks 40Y, 40M, 40C, and 40K. As a consequence, a multicolor image with reduced color misregistration is formed on the intermediate transfer belt 9.

Note that the method of forming marks 40 on the photosensitive drum 1 is not limited to the above-described example. For example, it is also possible to detect the rotational angle or surface position of the photosensitive drum 1 using an image bearing member position detector (not shown) and cause the exposure unit 3 to form electrostatic latent image lines and the marks 40 at equal angular intervals or at equal space intervals. By doing this, intervals at which the electrostatic latent image lines and the marks 40 are formed are held constant even when the rotational speed of the photosensitive drum 1 varies, which reduces disturbance in the control of causing the marks 41 and 40 to match each other.

Further, although in the present embodiment, each mark 40 is formed in timing synchronous with scanning of each scanning line of an electrostatic latent image, it is not absolutely necessary to use the same frequency. For example, each mark 40 may be formed in a different frequency (interval) than that of scanning of the scanning line of an electrostatic latent image by dividing or multiplying the frequency of scanning of the scanning line of the electrostatic latent image.

Although in the present embodiment, the marks 40 and the marks 41 are magnetically recorded on the magnetic recording layer, this is not limitative. For example, it is also possible to transfer an electrostatic latent image formed by the exposure unit 3 onto a conveying member, such as the intermediate transfer belt 9, and perform control using an electrostatic latent image formed on the photosensitive drum 1 and the electrostatic latent image transferred onto the conveying member. Further, a developed toner image may be used. For another example, control may be performed by providing a position detector for each of the photosensitive drums 1 and the intermediate transfer belt 9, and managing position information items from the position detectors as position indexes. Further, the different position indexes mentioned above may be used in combination. The method of forming marks 41 is not limited to magnetic recording. For example, marks may be formed by a method of directly transferring an electric charge without developing a latent image.

Next, a detailed description will be given, with reference to FIGS. 6 to 10B, of a method of adjusting the second timing and thereby correcting a deviation thereof from the first timing.

Figure 6:
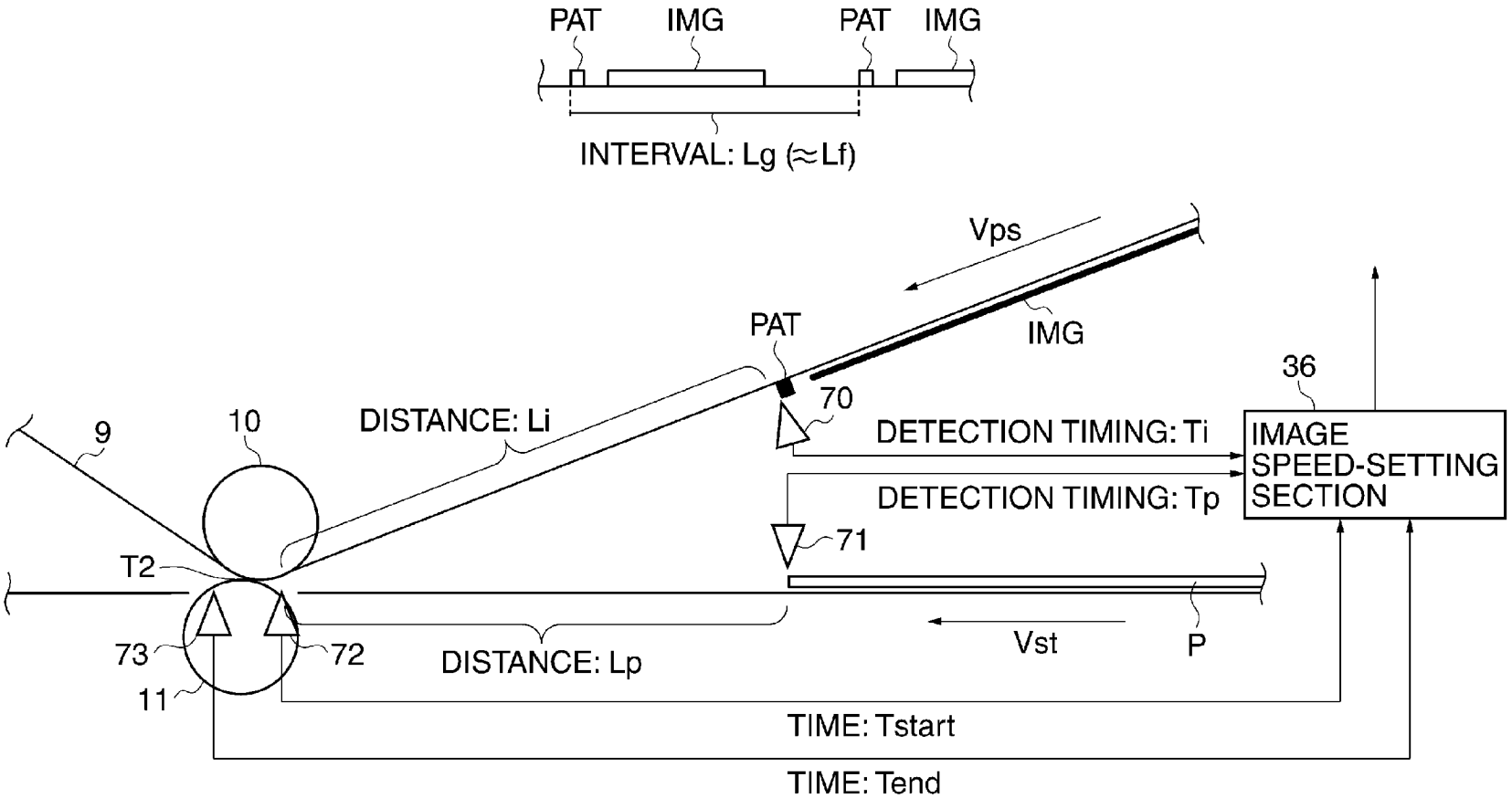
FIG. 6 is a schematic diagram useful in explaining control for determining an image speed by an image speed-setting section.

FIG. 6 is a schematic diagram useful in explaining control for determining the image speed Vps by the image speed-setting section 36.

As described hereinbefore, the image speed-setting section 36 is connected to the image position-detecting section 70, the sheet position-detecting section 71, the transfer start-detecting section 72, and the transfer end-detecting section 73. The transfer start-detecting section 72 is disposed in the conveying path at a location upstream of the transfer position T2 and close to the same. The transfer end-detecting section 73 is disposed in the conveying path at a location downstream of the transfer position T2 and close to the same.

The image position-detecting section 70 detects that a toner image formed on the intermediate transfer belt 9 has reached a detection position away from the transfer position T2 by a distance Li upstream in a first conveying direction in which the intermediate transfer belt 9 conveys the toner image. The sheet position-detecting section 71 detects that a sheet P has reached a detection position away from the transfer position T2 by a distance Lp upstream in a second conveying direction in which the conveying unit 50 conveys the sheet P.

The intermediate transfer belt 9 carries toner images IMG, and patch images PAT indicative of the respective positions of the toner images IMG on the intermediate transfer belt 9. The patch images PAT are formed at a predetermined space interval Lg. The space interval Lg is determined based on a feeding interval Lf of sheets P fed from the sheet feed cassette 20.

As described in detail hereinafter, the image speed Vps is changed from the reference speed Vref during a time period other than an image transfer operation period, i.e. during a time period from completion of transfer of an image onto a sheet P to immediately before the following sheet P reaches the transfer position T2. For this reason, it is desirable that the following sheet P and the following patch image PAT are detected immediately after completion of image transfer. Therefore, in the present embodiment, the distances Li and Lp are set substantially equal to the interval Lg (≈ the feeding interval Lf) so as to enable detection of the following patch image PAT and the following sheet P immediately after completion of image transfer, but this is not limitative. Throughout the image transfer operation period, the image speed Vps is held at the reference speed Vref. The sheet conveying speed Vst as a conveying speed of each sheet P is fixed.

The image position-detecting section 70 detects a time point (detection time T1) when a patch image PAT reaches (passes) the detection position of the image position-detecting section 70. The sheet position-detecting section 71 detects a time point (detection time Tp) when the leading edge of a sheet P reaches the detection position of the sheet position-detecting section 71. The transfer start-detecting section 72 detects a time point (time Tstart) when the leading edge of the sheet P reaches the detection position of the transfer start-detecting section 72. The transfer end-detecting section 73 detects a time point (time Tend) when the trailing end of the sheet P leaves (passes) the detection position of the transfer end-detecting section 73.

Figure 7:
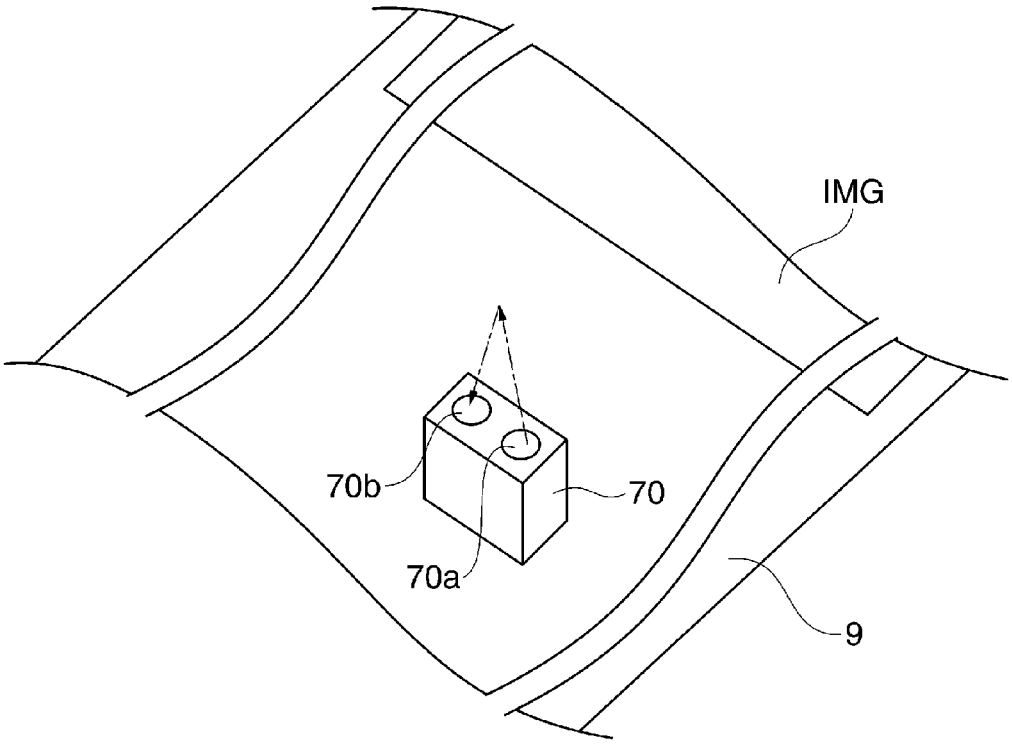
FIG. 7 is a perspective view of an image position-detecting section.

FIG. 7 is a perspective view of the image position-detecting section 70.

The image position-detecting section 70 is implemented by a photoreflector (reflective photointerrupter). A light beam emitted from a light emitting section 70*a* is reflected from a detection target, and is guided to a light receiving section 70*b*. The amount of received light detected by the light receiving section 70*b* varies depending on the reflectivity of the detection target, and the value of electric current output from an output terminal (not shown) varies with the amount of received light.

In the present embodiment, each patch image PAT is detected based on a difference in reflectivity between a plain background surface (i.e. a surface with no image formed thereon) of the intermediate transfer belt 9 and the patch image PAT. More specifically, the reflectivity of the patch image PAT is lower than that of the intermediate transfer belt 9, and therefore when the patch image PAT reaches the detection position of the image position-detecting section 70, the amount of light received by the image position-detecting section 70 is reduced. When the value of electric current output according to the amount of received light becomes lower than a threshold value, the image position-detecting section 70 detects that the patch image PAT has reached (passed) the detection position of the same.

Figure 8:
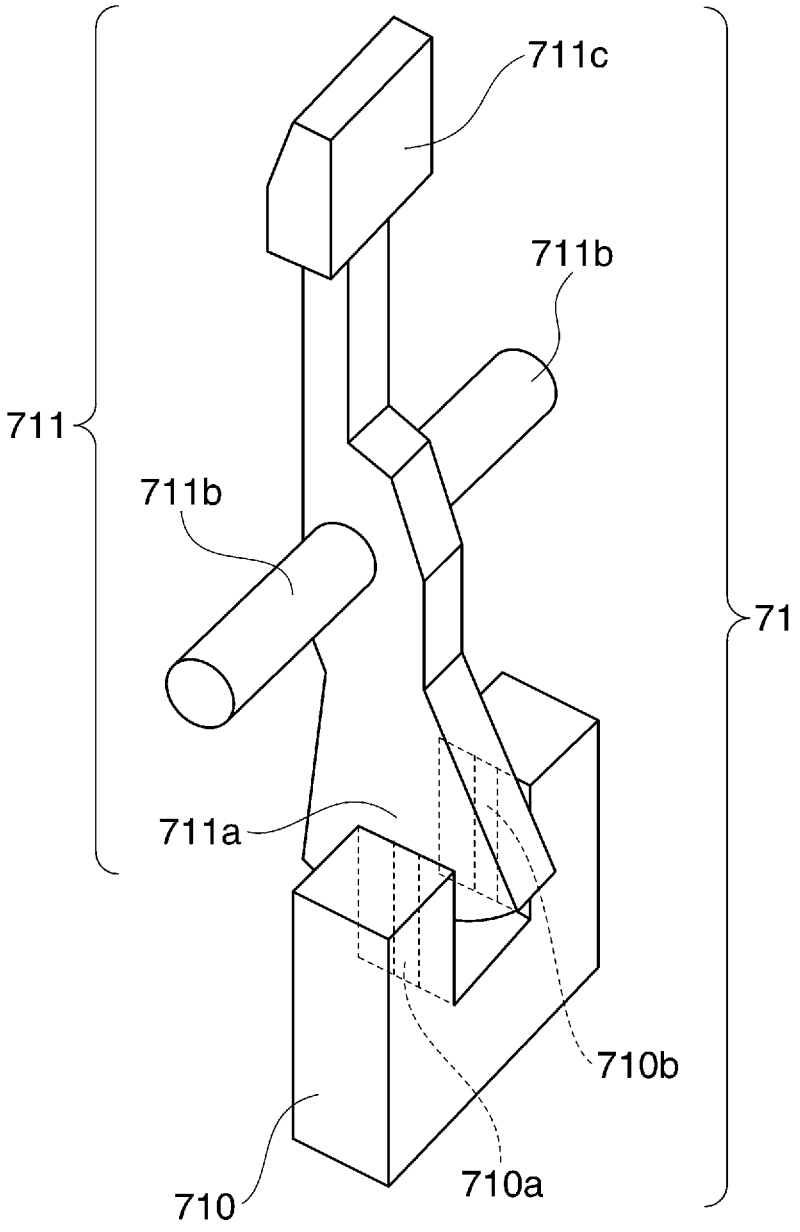
FIG. 8 is a perspective view of a sheet position-detecting section.

FIG. 8 is a perspective view of the sheet position-detecting section 71.

The sheet position-detecting section 71 comprises a photointerrupter 710 and a sensor flag 711. The photointerrupter 710 includes a light emitting section 710*a* and a light receiving section 710*b* disposed at respective locations opposed to each other, and when a light beam emitted from the light emitting section 710*a* is received by the light receiving section 710*b*, an electric current is output from an output terminal, not shown.

The sensor flag 711 has a pivotal support shaft 711*b* pivotally supported by a pivotal support member, not shown. One extended portion of the sensor flag 711 is formed with a light blocking portion 711*a*, and the other extended portion of the same is provided with an abutment portion 711*c*. The abutment portion 711*c* is located on an opposite side of the pivotal support shaft 711*b* from the light blocking portion 711*a*.

In a state where a sheet P has not reached the sheet position-detecting section 71, the sensor flag 711 is held in an upright position. In this state, the light blocking portion 711*a* is in a light blocking position between the light emitting section 710*a* and the light receiving section 710*b* so as to block light, so that no electric current is output and therefore it is determined that no sheet has been detected.

When the currently conveyed sheet P is brought into abutment with the abutment portion 711*c*, the sensor flag 711 turns about the pivotal support shaft 711*b*, whereby the light blocking portion 711*a* having been positioned in the light blocking position is moved to a light passing position. This causes an electric current to be output from the output terminal of the photointerrupter 710, whereby passage of the sheet P is detected.

The transfer start-detecting section 72 and the transfer end-detecting section 73 are similar in construction to the sheet position-detecting section 71, and therefore description thereof is omitted.

Note that the construction of each of the image position-detecting section 70, the sheet position-detecting section 71, the transfer start-detecting section 72, and the transfer end-detecting section 73 is not limited to that given above by way of example. For example, the sheet position-detecting section 71 may be implemented by a photoreflector similar to the image position-detecting section 70 is. Alternatively, a line sensor, such as a CMOS, or an area sensor may be used. Further, a mechanism enabling prediction of an associated one of times Ti, Tp, Tstart, and Tend may be used.

In the present embodiment, a merged conveying path (not shown) for execution of double-sided printing is disposed upstream of the sheet position-detecting section 71 in the second conveying direction in which a sheet P is conveyed by the conveying unit 50. This makes it possible to set the image speed Vps even in a double-sided printing mode.

FIG. 9 is a flowchart of an image speed-setting process for setting the image speed Vps.

First, simultaneously when image formation is started, the image speed-setting section 36 starts calculation of the image speed Vps (step S101). Initially, the image speed-setting section 36 sets the image speed Vps to the reference speed Vref (e.g. 200 mm/s) (step S102).

Then, the image speed-setting section 36 determines the method of calculating the image speed Vps depending on which of the detection of the image position detecting time T1 by the image position-detecting section 70 and the detection of the sheet position detecting time Tp by the sheet position-detecting section 71 is earlier (step S103). More specifically, the image speed-setting section 36 awaits detection of the image position detecting time T1 and determines, based on whether or not the time Tp has been acquired when the time T1 is detected, whether or not detection of the time T1 is earlier than detection of the time Tp.

A case where detection of the time T1 is earlier than detection of the time Tp corresponds to a case where the time T1 is acquired in a state in which the time Tp has not been detected, i.e. a case where detection of the patch image PAT is earlier than detection of the sheet P. A case where detection of the time Tp is earlier than detection of the time T1 corresponds to a case where the time T1 is acquired in a state in which the time Tp has been detected, i.e. a case where detection of the sheet P is earlier than detection of the patch image PAT.

If detection of the time T1 is earlier than detection of the time Tp, the image speed-setting section 36 proceeds to a step S104. On the other hand, if detection of the time Tp is earlier than detection of the time T1, the image speed-setting section 36 proceeds to a step S114.

In the step S104, the image speed-setting section 36 sets the image speed Vps to a minimum allowable image speed Vpslow. Then, in a step S105, the image speed-setting section 36 awaits the time Tp when the sheet P is detected by the sheet position-detecting section 71. The image speed-setting section 36 awaits detection of the time Tp until an allowable wait time period ΔTwait elapses (step S106).

The allowable wait time period ΔTwait is time that can be spared when the image speed Vps is set to the minimum allowable image speed Vpslow so as to maximize a time period taken for an image IMG to reach the transfer position T2. The allowable wait time period ΔTwait is determined by the following equation (1):

$$\Delta T\text{wait}=Li/Vp\text{slow}-Lp/Vst \quad (1)$$

In a case where the allowable wait time period ΔTwait has elapsed with the time Tp undetected, the image IMG reaches the transfer position T2 earlier than the sheet P (image preceding). This makes it impossible for a transfer process to perform accurate transfer of the image IMG to a predetermined position on the sheet P.

To avoid this, in the case where the sheet P is not detected by the sheet position-detecting section 71 even after the lapse of the allowable wait time period ΔTwait, the image speed-setting section 36 stops the image forming apparatus 100 and notifies the user of a JAM error by outputting a JAM error message (step S108).

On the other hand, when the sheet P is detected and the time Tp can be acquired in the step S105 before the lapse of the allowable wait time period ΔTwait, there is enough time left to make the second timing coincident with the first timing by increasing the speed of the intermediate transfer belt 9. Therefore, the image speed-setting section 36 calculates the image speed Vps by the following equation (2) (step S107):

$$Vps=(Li-(Tp-Ti)\times Vp\text{slow})/(Lp/Vst) \quad (2)$$

According to this equation (2), it is possible not only to calculate the position of the image IMG at the time of acquisition of the time Tp, but also to predict a time at which the sheet P will reach the transfer position T2. Based on the prediction, the image speed Vps is calculated as an appropriate image speed to be set at the time Tp for making the timing of arrival of the image IMG coincident with the timing of arrival of the sheet P.

Then, in a step S109, the image speed-setting section 36 determines whether or not the transfer start time Tstart has come. The image speed-setting section 36 holds the image speed Vps at a value calculated by the equation (2) until the transfer start time Tstart is detected. When the transfer start time Tstart has come, the image speed-setting section 36 proceeds to a step S110.

In the step S114, the image speed-setting section 36 calculates the image speed Vps by the following equation (3):

$$Vps=Li/(Tp+(Lp/Vst)-Ti) \quad (3)$$

The equation (3) is used to predict a time at which the sheet P reaches the transfer position T2, and calculate the image speed Vps as an appropriate image speed to be set at the time T1 for making the timing of arrival of the image IMG coincident with the timing of arrival of the sheet P.

Then, the image speed-setting section 36 determines whether or not the calculated image speed Vps is lower than a maximum allowable image speed Vpshigh (step S115). If Vps Vpshigh, it is impossible to make the second timing coincident with the first timing even if the speed of the intermediate transfer belt 9 is increased. Therefore, the image speed-setting section 36 executes error handling in the step S108.

On the other hand, if Vps<Vpshigh, the image speed-setting section 36 determines in a step S116 whether or not the transfer start time Tstart has come. The image speed-setting section 36 holds the image speed Vps at the value calculated using the equation (3) until the transfer start time Tstart is detected. When the transfer start time Tstart has come, i.e. it is detected, the image speed-setting section 36 proceeds to the step S110.

When the transfer start time Tstart is detected in the step S109 or S116, the image speed-setting section 36 changes the image speed Vps to the reference speed Vref in the step S110. The step S110 is executed so as to hold the image transfer condition constant to thereby maintain the high image quality of an image transferred onto a sheet P. The reference speed Vref and the sheet conveying speed Vst are set to substantially the same value.

Then, the image speed-setting section 36 determines whether or not the transfer end time Tend has been detected (step S111). The image speed-setting section 36 holds Vps=Vref until the transfer end time Tend is detected. When the transfer end time Tend is detected, the image speed-setting section 36 proceeds to a step S112. A time period from detection of the transfer start time Tstart to detection of the transfer end time Tend corresponds to a predetermined time period including a time period during which transfer is performed, i.e. the above-mentioned transfer operation period.

Then, in the step S112, the image speed-setting section 36 determines whether or not the print job has been completed. If the print job has not been completed, the image speed-setting section 36 returns to the step S103. On the other hand, if the print job has been completed, the image speed-setting section 36 terminates the FIG. 9 process.

Note that before detection of the transfer end time Tend, a sheet position detection time Tp or an image position detection time T1 associated with the following job can be detected. In this case, it is only required to store the times Tp and Ti in a storage section (not shown) and use these in the following steps.

Figure 10A:
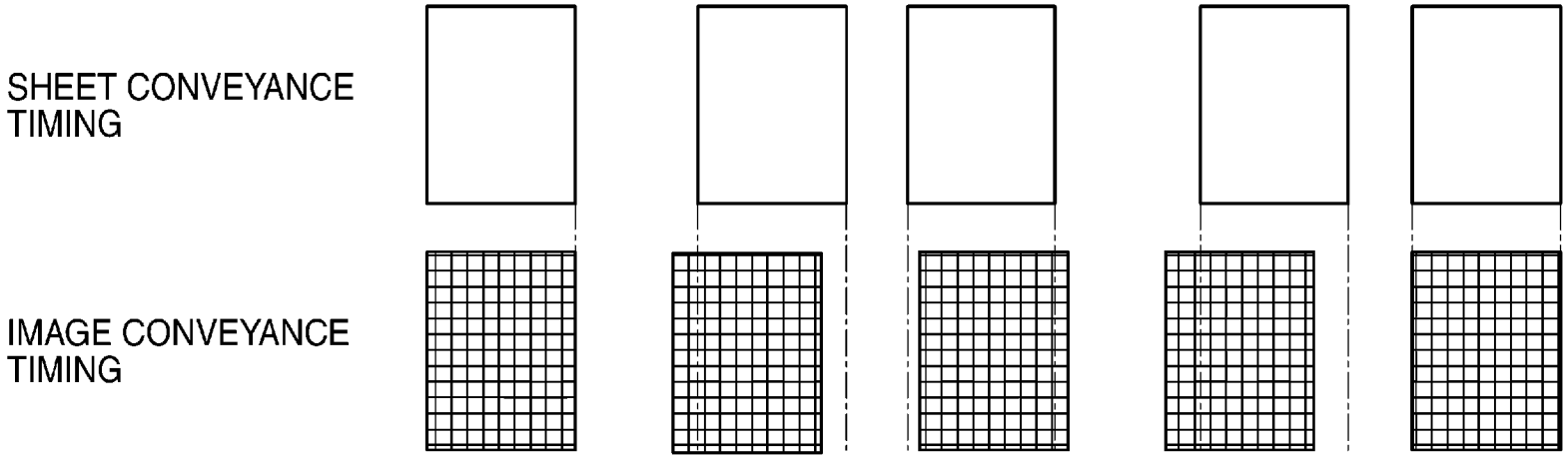
FIGS. 10A and 10B are timing diagrams useful in explaining control of the image speed by the image forming apparatus.
Figure 10B:
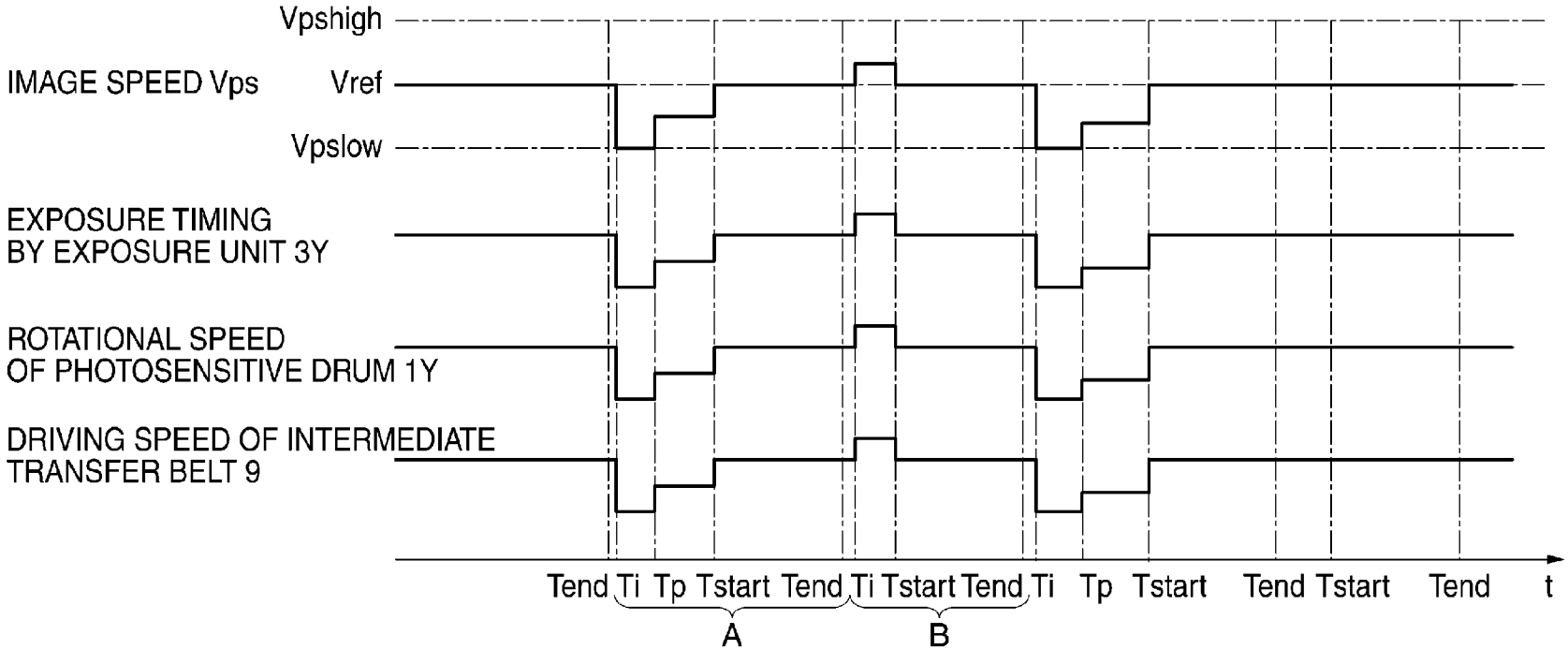

FIGS. 10A and 10B are timing diagrams useful in explaining control of the image speed Vps by the image forming apparatus 100.

FIG. 10A shows cases where sheet conveyance timing and image conveyance timing match each other and cases where they are different (cases in which the latter is advanced from the former and a case where the latter is delayed from the former). FIG. 10B shows changes in the image speed Vps controlled according to the difference between the sheet conveyance timing and the image conveyance timing, exposure timing by the exposure unit 3Y, rotational speed of the photosensitive drum 1Y, and driving speed of the intermediate transfer belt 9. Changes in a time period indicated by A in FIG. 10B correspond to the case where the FIG. 9 process proceeds from the steps S103 to S107 to the steps S109 to S111. Changes in a time period indicated by B in FIG. 10B correspond to the case where the FIG. 9 process proceeds from the steps S103 to S114 through the steps S116 to S110 to the step S111.

As described above, the image speed Vps is changed according to a conveyance interval between sheets which are conveyed in succession and also during a period other than the image transfer operation period. As a consequence, transfer timing and the driving speed of the intermediate transfer belt 9 are controlled based on the image speed Vps.

According to the present embodiment, the sheet conveying speed is not changed, but the conveying speed of the intermediate transfer belt 9 is controlled. As a consequence, it is possible to reduce occurrence of sheet jamming than when the method of controlling the sheet conveying speed is employed, which improves the reliability of operations related to conveyance of sheets P.

By the way, when the conveying speed of an image is variable, it is necessary to take care to suppress occurrence of image expansion or contraction and color misregistration. However, in the present embodiment, the exposure timing and the rotation of the photosensitive drum 1Y are controlled according to the image speed Vps, and therefore, image expansion or contraction associated with the image forming unit PY is suppressed. Further, each of the photosensitive drums 1M, 1C, and 1K has its rotation controlled such that the marks 40 and 41 are synchronized at the respective transfer positions T, so that the rotation of each drum is controlled substantially according to the image speed Vps, and the exposure timing and so forth are similarly controlled. Therefore, image expansion or contraction in each of the image forming units PM, PC, and PK is also suppressed. Thus, the image transfer timing is adjusted according to the image speed Vps, and therefore, occurrence of image expansion or contraction and color misregistration are suppressed, which makes it possible to maintain high image quality.

As described above, according to the present embodiment, it is possible to suppress lowering of reliability of operations associated with sheet conveyance while maintaining image quality.

Next, a description will be given of a second embodiment of the present invention with reference to FIGS. 11 to 15. The second embodiment is basically distinguished from the first embodiment by the method of calculation and setting of the image speed Vps.

Figure 11:
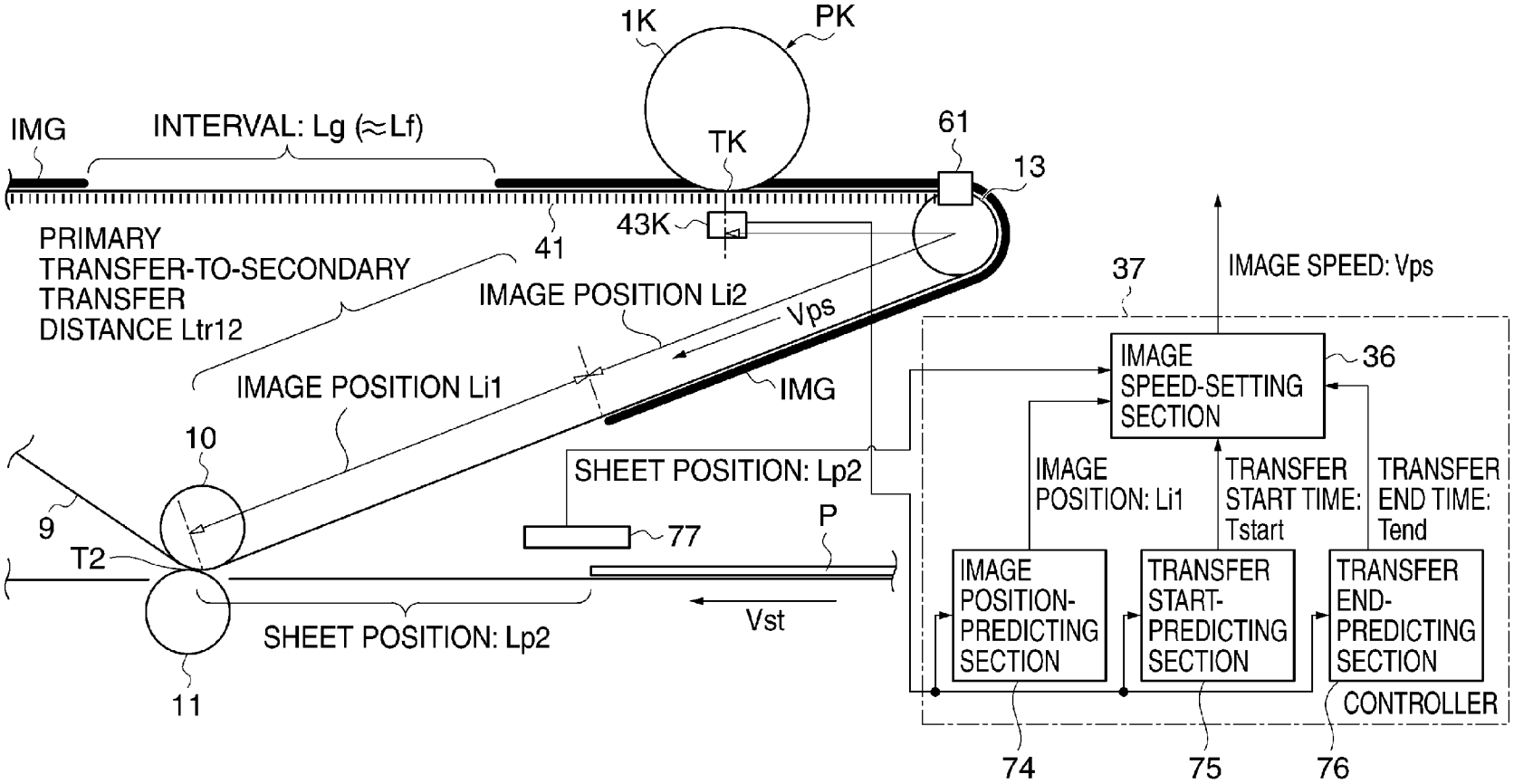
FIG. 11 is a schematic diagram useful in explaining control for determining an image speed by an image speed-setting section of an image forming apparatus according to a second embodiment of the present invention.

FIG. 11 is a schematic diagram useful in explaining control for determining the image speed Vps by the image speed-setting section 36 of the image forming apparatus according to the second embodiment. In FIG. 11, the same components as those in the first embodiment are denoted by the same reference numerals, and detailed description thereof is omitted. The image forming units PY, PM, and PC are omitted from illustration. As for the image forming unit PK as well, the mark forming device 45K, the mark reading device 42K, the erasing device 60K, and the marks 40K are omitted from illustration.

In the second embodiment, the detection sections 70 to 73 provided in the first embodiment are eliminated, and a controller 37 and a sheet position-detecting section 77 are provided instead. The function of the first detection unit configured to detect images IMG is basically performed by the mark reading device 43K with which the image position-detecting section 70 is replaced. The function of the second detection unit configured to detect conveyed sheets P is basically performed by the sheet position-detecting section 77 with which the sheet position-detecting section 71 is replaced.

The present embodiment is identical to the first embodiment in that transfer timing is adjusted according to the image speed Vps. Further, configurations and operations, not particularly described, are the same as those in the first embodiment. The following description is given, with reference to FIGS. 11 to 15, of a method of setting the image speed Vps and a method of correcting a difference between the first timing and the second timing, by adjusting the second timing.

As shown in FIG. 11, the controller 37 incorporates the image speed-setting section 36, an image position-predicting section 74, a transfer start-predicting section 75, and a transfer end-predicting section 76. The image position-predicting section 74, the transfer start-predicting section 75, and the transfer end-predicting section 76 are connected to the image speed-setting section 36 within the controller 37. Further, the sheet position-detecting section 77 is connected to the image speed-setting section 36.

The interval Lg between images IMG is substantially equal to the feeding interval Lf as in the first embodiment (see FIG. 6). The sheet position-detecting section 77 is disposed such that the center of the detection area thereof is positioned at a location away from the transfer position T2 upstream in the sheet conveying direction by a distance equal to the feeding interval Lf.

By disposing the sheet position-detecting section 77 at the location away from the transfer position T2 by the distance equal to the feeding interval Lf, it is possible to perform sheet detection near the center of the detection area of the sheet position-detecting section 77, which makes it possible to make most use of the detection area. However, the disposed location of the sheet position-detecting section 77 is not limited to this.

The image speed Vps is changed from the reference speed Vref during a time period other than an image transfer operation period as in the first embodiment. For this reason, the present embodiment is configured such that detection of the following sheet P and the following image IMG is executed at an image/sheet detection time Tip immediately after completion of image transfer.

By the way, for detection of a first print sheet in a print job, the image/sheet detection time Tip is set to a time point at which the leading edge of the sheet P is detected by the sheet position-detecting section 77, whereas for detection of each of second and subsequent print sheets, the image/sheet detection time Tip is set to a time point immediately after the transfer end time Tend. Note that the transfer end time Tend may be set to a predetermined time point or set with reference to another time point, such as the transfer start time Tstart.

The sheet position-detecting section 77 picks up an image of the leading edge of a sheet P to thereby detect a sheet position Lp2 which is defined as a distance from the transfer position T2 to the leading edge of the sheet P in the upstream direction of sheet conveyance at the image/sheet detection time Tip as a predetermined time point. The image position-predicting section 74 predicts an image position Li1 of an image IMG at the image/sheet detection time Tip, based on the conveying position of the intermediate transfer belt 9 determined from the result of detection of a mark 41 by the mark reading device 43K. The image position Li1 is defined as a distance from the transfer position T2 to the position of the leading end of the image IMG in the upstream direction of image conveyance at the image/sheet detection time Tip.

The transfer start-predicting section 75 predicts the transfer start time Tstart at which image transfer is to be started, based on the conveying position of the intermediate transfer belt 9 determined from the result of detection of the marks 41 by the mark reading device 43K.

The transfer end-predicting section 76 predicts the transfer end time Tend at which image transfer is to be completed, based on the conveying position of the intermediate transfer belt 9 determined from the result of detection of the mark 41 by the mark reading device 43K.

Further, in the present embodiment, a merged conveying path (not shown) for execution of double-sided printing is disposed upstream of the sheet position-detecting section 77 in the sheet conveying direction. This makes it possible to determine the image speed Vps by the same method both in the single-sided printing mode and the double-sided printing mode.

Figure 12:
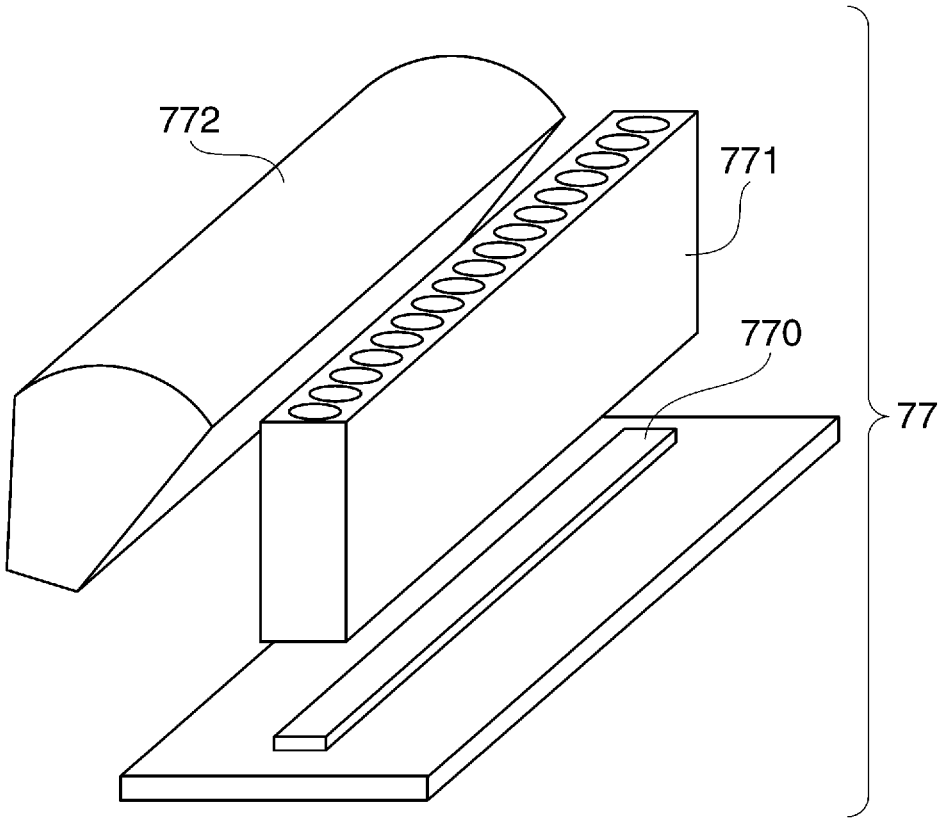
FIG. 12 is a perspective view of a sheet position-detecting section of the image forming apparatus according to the second embodiment.

FIG. 12 is a perspective view of the sheet position-detecting section 77.

The sheet position-detecting section 77 comprises a CMOS line sensor 770, a rod lens array 771, and a light emitting section 772. Light emitted from the light emitting section 772 is irradiated and reflected from the surface of an object to be detected, and the reflected light passes through the rod lens array 771 to form an image on the line sensor 770. The line sensor 770 detects the amount of the light that forms the image on a pixel-by-pixel basis, and converts the detected light to an electric signal. The line sensor 770 used in the present embodiment has a pixel pitch of 600 dpi and is capable of detecting the position of the leading edge of a sheet P with a resolution of 42.3 μm.

Figure 13:
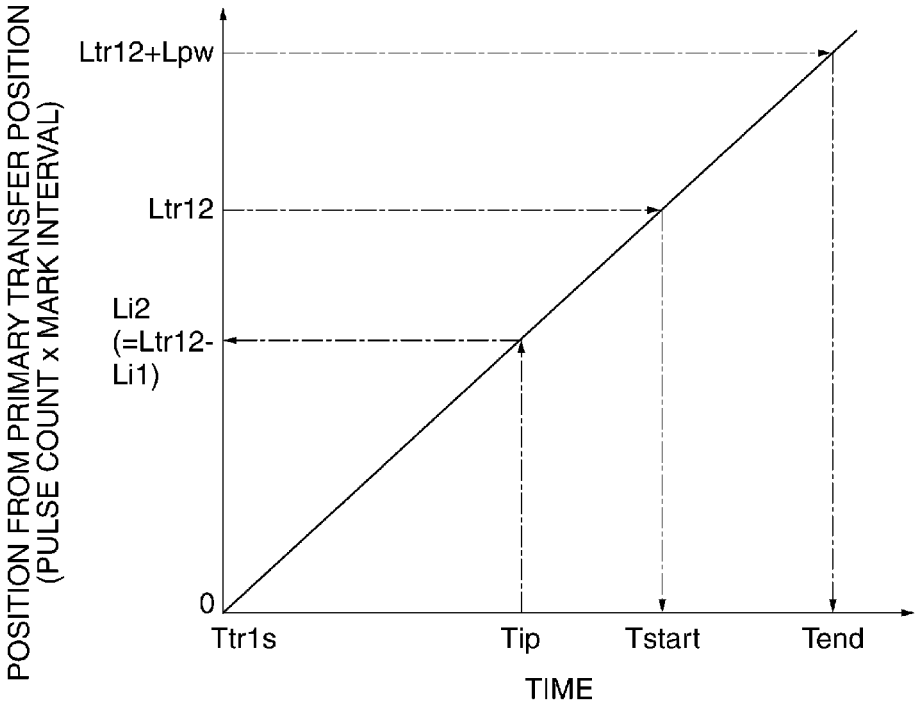
FIG. 13 is a diagram showing the relationship between positions to which an image on an intermediate transfer belt is conveyed and elapsed time.

FIG. 13 is a diagram showing the relationship between positions to which an image on the intermediate transfer belt is conveyed and elapsed time.

The image position-predicting section 74 incorporates a pulse counter. A time point of detection of a mark 41 corresponding to the first scanning line of a toner image on the photosensitive drum 1K by the mark reading device 43K is represented by Ttr1*s*. The count of the pulse counter is reset to zero at the time Ttr1*s*, and the pulse counter starts counting pulses of a detection pulse signal output from the mark reading device 43K.

Then, the image position-predicting section 74 calculates an image position Li2 by the following equation (4), based on the count Ci of the pulse counter obtained at the image/sheet detection time Tip. The image position Li2 is defined as a distance from the transfer position TK of the image forming unit PK to the leading edge of the image IMG downstream in the image conveying direction.

$$Li2=Ci\times\Delta L \tag{4}$$

In the above equation, ΔL represents an interval between the marks 41. In the present embodiment, ΔL=42.3 μm, but this is not limitative.

Then, the image position-predicting section 74 calculates the image position L1 of the image IMG detected at the image/sheet detection time Tip, using a distance Ltr12 from the transfer position TK to the transfer position T2 (hereinafter also referred to as "the primary transfer-to-secondary transfer distance"). The image position Li1 is calculated by the following equation (5):

$$Li1=Ltr12-Li2 \tag{5}$$

The transfer start-predicting section 75 incorporates a pulse counter. Similar to the image position-predicting section 74, the transfer start-predicting section 75 resets the count of the pulse counter to zero at the time Ttr1*s*, and the pulse counter starts counting pulses of a detection pulse signal output from the mark reading device 43K.

The transfer start-predicting section 75 outputs a detection signal at the instant (transfer start time Tstart) when the counter value reaches a value corresponding to the primary transfer-to-secondary transfer distance, i.e. the distance Ltr12.

The transfer end-predicting section 76 incorporates a pulse counter. Similar to the image position-predicting section 74, the transfer end-predicting section 76 resets the count of the pulse counter to zero at the time Ttr1*s*, and the pulse counter starts counting pulses of a detection pulse signal output from the mark reading device 43K.

In the transfer end-predicting section 76, from the moment that a mark 41 corresponding to the last scanning line of the toner image on the photosensitive drum 1K is detected by the mark reading device 43K, counting is further continued up to a value corresponding to the distance Ltr12. Then, the transfer end-predicting section 76 outputs a detection signal at the instant (transfer end time Tend) when the counter value reaches the value corresponding to the distance Ltr12.

Lpw in FIG. 13 represents a value counted over a time period from the time Ttr1*s* to a time point at which the mark reading device 43K detects the mark 41 corresponding to the last scanning line of the toner image on the photosensitive drum 1K.

Although in the present embodiment, sheet edge positions are detected by the line sensor described hereinabove, this is not limitative. For example, an area detection-type sensor may be used for sheet edge detection.

Further, although in the present embodiment, the image positions Li (Li1, Li2), the time Tstart, and the time Tend are not measured, but predicted instead, sensors dedicated for the respective parameters may be provided so as to acquire values by measurement.

Figure 14:
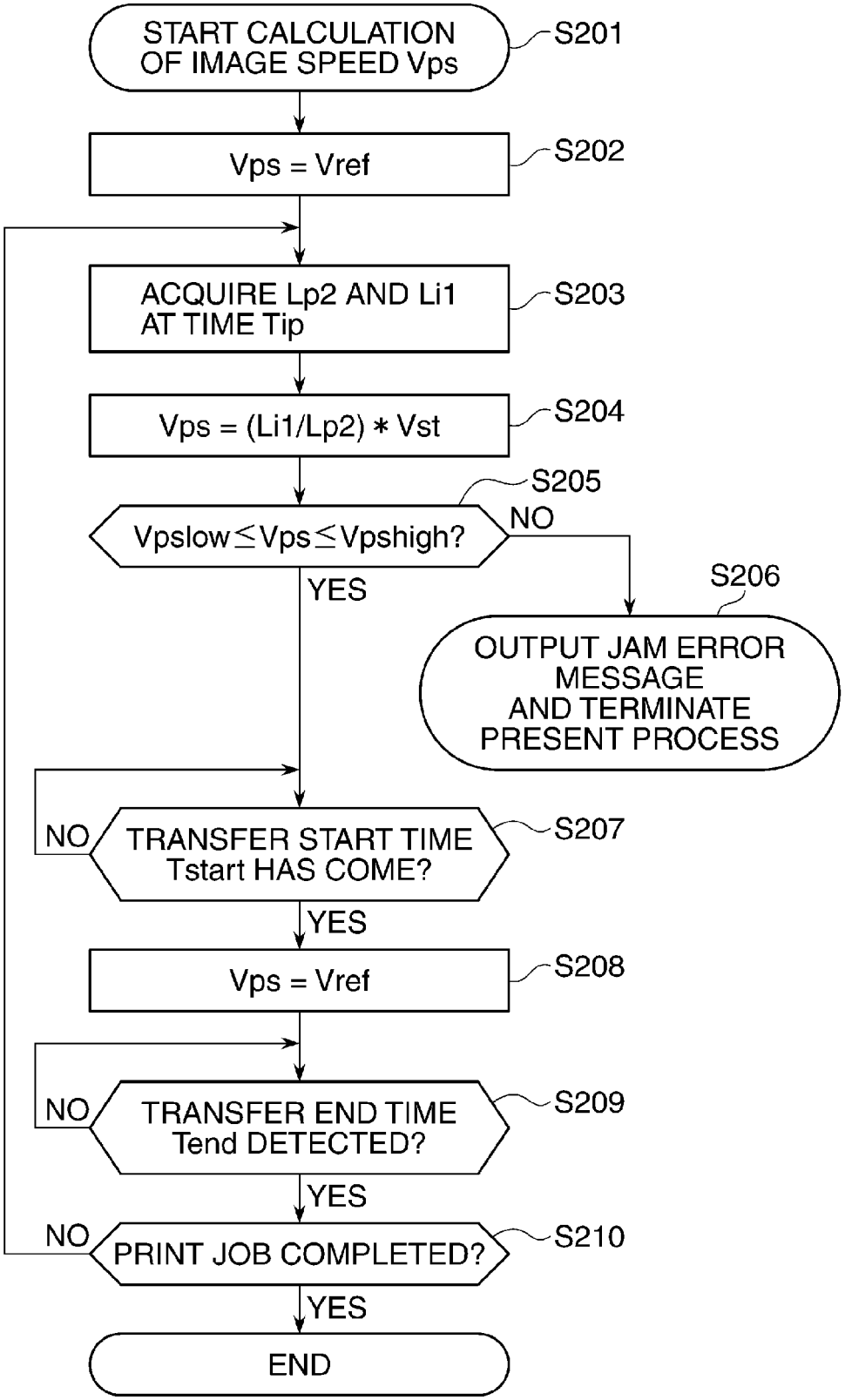
FIG. 14 is a flowchart of an image speed-setting process by the image forming apparatus according to the second embodiment.

FIG. 14 is a flowchart of an image speed-setting process for setting the image speed Vps by the image forming apparatus 100 according to the second embodiment.

First, in steps S201 and S202, the image speed-setting section 36 executes the same processing as in the steps S101 and S102 in FIG. 9.

Next, in a step S203, the image speed-setting section 36 acquires the image position Li1 of the image IMG through calculation of the image position Li2 at the image/sheet detection time Tip (see the equations (4) and (5)). Further, the image speed-setting section 36 acquires the sheet position Lp2 detected by the sheet position-detecting section 77 at the image/sheet detection time Tip.

Then, the image speed-setting section 36 calculates, using the values Li1 and Lp2 and the sheet conveying speed Vst, the image speed Vps by the following equation (6) (step S204):

$$Vps=(Li1/Lp2)\times Vst \quad (6)$$

The equation (6) is used to calculate an appropriate image speed Vps from a ratio between a distance from an image IMG to the transfer position T2 and a distance between a sheet P to the transfer position T2, so as to make timing at which the image IMG reaches the transfer position T2 coincident with timing at which the sheet P reaches the transfer position T2.

Then, the image speed-setting section 36 determines whether the calculated image speed Vps is not lower than the minimum allowable image speed Vpslow and also not higher than the maximum allowable image speed Vpshigh (step S205). If it is determined that Vpslow≤Vps≤Vpshigh does not hold, the image speed-setting section 36 executes the same error handling in a step S206, as in the step S108 in FIG. 9.

On the other hand, if it is determined that Vpslow≤Vps≤Vpshigh holds, the image speed-setting section 36 determines whether or not the transfer start time Tstart has come (step S207). The image speed-setting section 36 holds the image speed Vps at the value calculated by the equation (6) until the transfer start time Tstart is detected. Then, when the transfer start time Tstart is detected, the image speed-setting section 36 proceeds to a step S208.

In the step S208 and the following steps S209 and S210, the image speed-setting section 36 performs the same processing as in the steps S110 to S112 in FIG. 9. If it is determined in the step S210 that a print job has not been completed, the image speed-setting section 36 returns to the step S203, whereas if the print job has been completed, the image speed-setting section 36 terminates the FIG. 14 process.

Figure 15:
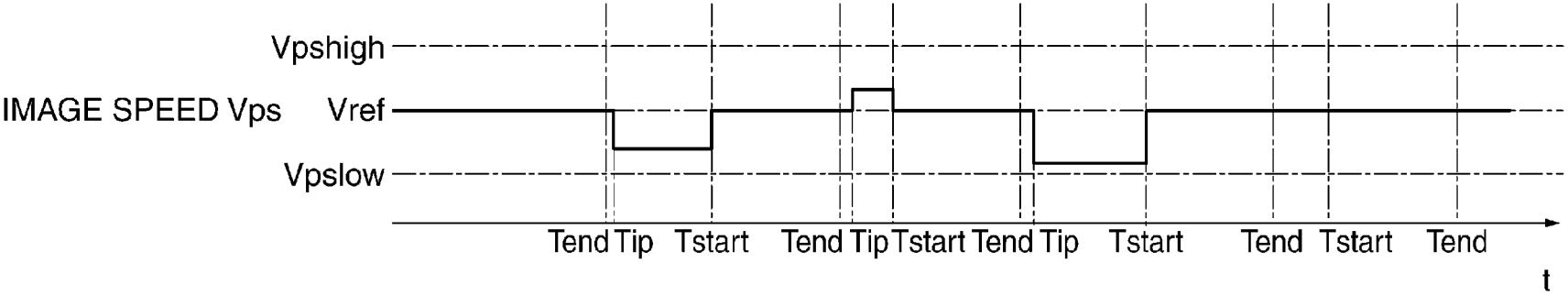
FIG. 15 is a timing diagram showing an example of control of the image speed by the image forming apparatus according to the second embodiment.

FIG. 15 is a timing diagram showing an example of control of the image speed Vps by the image forming apparatus 100 according to the second embodiment.

The image speed Vps is set based on the image positions Li1 and Li2 obtained from the result of detection performed by the mark reading device 43K at the image/sheet detection time Tip and the sheet position Lp2 detected by the sheet position-detecting section 77 at the same image/sheet detection time Tip (see the equation (6)). The image speed Vps is set immediately after each transfer end time Tend and during a time period other than an image transfer operation period, such that the second timing becomes coincident with the first timing. This makes it possible to reduce occurrence of sheet jamming as in the first embodiment, which contributes to improvement of reliability of operation associated with sheet conveyance.

Further, it is to be understood that the exposure timing and the transfer timing are also controlled based on the image speed Vps as in the first embodiment.

According to the present embodiment, it is possible to provide the same advantageous effect as provided by the first embodiment in that lowering of reliability of operations associated with sheet conveyance can be suppressed while maintaining image quality.

Further, since the second timing and the first timing are predicted by detecting the image positions Li1 and Li2 and the sheet position Lp2 at the image/sheet detection time Tip, it is possible to simplify the processing for determining the image speed Vps.

Figure 16:
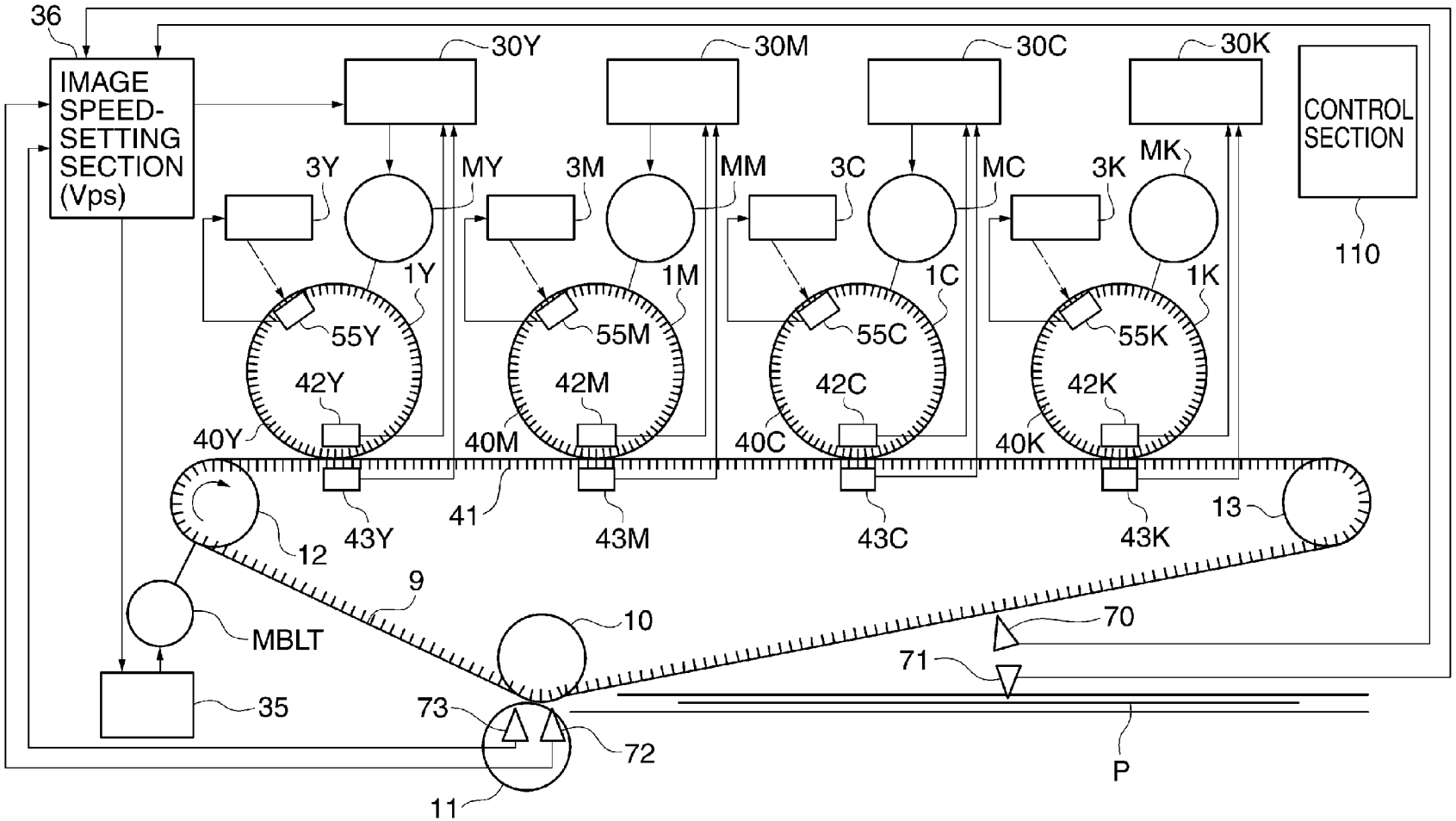
FIG. 16 is a control block diagram of an image forming apparatus according to a third embodiment of the present invention.

FIG. 16 is a control block diagram showing a configuration mainly concerning control of the photosensitive drums 1Y, 1M, 1C, and 1K, the intermediate transfer belt 9, and the exposure units 3Y, 3M, 3C, and 3K of an image forming apparatus according to a third embodiment of the present invention.

In FIG. 16, the same components as those in the first embodiment are denoted by the same reference numerals, and detailed description thereof is omitted.

In the present embodiment, the marks 40 and the marks 41 are provided permanently in advance.

In the first embodiment, the mark forming device 45 forms a mark 40 on the photosensitive drum 1 in timing synchronous with scanning of a scanning line on the photosensitive drum 1 by the exposure unit 3. Further, the mark 40 is removed by the erasing device 60 after having been detected by the mark reading device 42.

However, in the present embodiment, the permanent marks 40Y, 40M, 40C, and 40K are formed in advance on the respective photosensitive drums 1Y, 1M, 1C, and 1K, and each of the mark reading devices 42Y, 42M, 42C, and 42K detects the associated marks 40.

As for the marks 41, in the first embodiment, each of the marks 41 is formed on the intermediate transfer belt 9 by the mark forming device 46 in timing synchronous with detection of a mark 40Y by the mark reading device 42Y. The marks 41 are removed by the erasing device 61 at a location downstream in the conveying direction of the intermediate transfer belt 9.

On the other hand, in the present embodiment, the permanent marks 41 are formed in advance on the intermediate transfer belt 9, and each of a mark reading device 43Y and the mark reading devices 43M, 43C, and 43K detects the marks 41.

Therefore, the present embodiment is distinguished from the first embodiment in that the mark forming devices 45 are eliminated and mark reading devices 55 (55Y, 55M, 55C, and 55K) are provided. Further, as for the photosensitive drum 1Y, the mark forming device 46 is eliminated, and the mark reading device 43Y is provided at a location where the mark forming device 46 was disposed. The mark reading devices 43M, 43C, and 43K associated with the respective photosensitive drums 1M, 1C, and 1K are provided as in the first embodiment. The erasing devices 60 and 61 are eliminated.

Specifically, the marks 40 are formed on the outer or inner peripheral surface of the photosensitive drum 1 at equal space intervals, and the marks 41 are formed on the outer or inner surface of the intermediate transfer belt 9 at equal space intervals. Each of the mark reading devices 55 is implemented e.g. by an optical sensor, and reads the marks 40 on the associated one of the photosensitive drums 1. The mark reading device 43Y is identical in configuration to the mark reading devices 43M, 43C, and 43K.

Each of the mark reading devices 55 is disposed at a location corresponding to where the associated one of the exposure units 3 forms an electrostatic latent image on the associated one of the photosensitive drums 1. Each of the mark reading devices 55 detects a mark 40 and outputs a detection signal to the associated exposure unit 3.

Each of the exposure units 3 forms an electrostatic latent image on the associated photosensitive drum 1 in synchronism with a detection signal output from the associated mark reading device 55. This makes it possible to form scanning lines of the electrostatic latent image at respective locations corresponding to the marks 40. Thus, the scanning lines of the electrostatic latent images are formed on the photosensitive drum 1 at the same space intervals as those of the marks 40. Note that in the present embodiment, the exposure unit 3 is implemented by a solid exposure device (LED array).

In the present embodiment as well, the speed of the intermediate transfer belt 9 is changed based on the image speed Vps while controlling the transfer timing, thereby achieving formation of a high-quality image with reduced image expansion or contraction and reduced color misregistration.

As for the transfer timing in the present embodiment, first, in the photosensitive drum 1Y, the mark reading device 55Y detects the marks 40Y, whereby the exposure unit 3Y has its exposure timing controlled based on a change in the speed of the photosensitive drum 1Y. More specifically, an electrostatic latent image is formed on the photosensitive drum 1Y in synchronism with a detection signal output from the mark reading device 55Y, so that a predetermined exposure interval is maintained.

Further, the motor MY is controlled based on outputs from the respective mark reading devices 42Y and 43Y such that the marks 40 match the respective marks 41 and the circumferential speed of the photosensitive drum 1Y becomes equal to the image speed Vps.

Therefore, it is possible to control the transfer timing by changing the speed of the photosensitive drum 1Y, so that even when the speed of the intermediate transfer belt 9 is changed, a yellow image is transferred onto the intermediate transfer belt 9, as an image with substantially no image expansion or contraction.

To superimpose toner images of the respective four colors, an electrostatic latent image is formed on each of the photosensitive drums 1M, 1C, and 1K in synchronism with a detection signal output from an associated one of the mark reading devices 55M, 55C, and 55K. Further, as in the first embodiment, each of the photosensitive drums 1M, 1C, and 1K is caused to be rotated such that the marks 40 thereon match the respective marks 41. In other words, the image transfer timing is controlled by driving each of the photosensitive drums 1M, 1C, and 1K such that the scanning lines of each image thereon match the respective scanning lines of the yellow image transferred onto the intermediate transfer belt 9, so that a multicolor image with reduced color misregistration is formed on the intermediate transfer belt 9.

Further, voltages to be applied to the charging unit 2, the developing unit 4, the transfer roller 5, and the transfer roller 11, respectively, are changed based on the image speed Vps. Furthermore, as for the developing unit 4, the circumferential speed of the developing sleeve is also changed such that a predetermined ratio is maintained between the same and the image speed Vps.

Thus, the transfer timing is adjusted.

The control of adjusting the second timing based on the image speed Vps set by the image speed-setting section 36 based on detection results from the respective detection sections 70 to 73, thereby making the second timing coincident with the first timing is the same as that in the first embodiment.

According to the present embodiment, it is possible to provide the same advantageous effect as provided by the first embodiment in that lowering of reliability of operations associated with sheet conveyance can be suppressed while maintaining image quality.

Further, since the marks 40 and 41 are permanent marks, the devices for erasing the marks 40 and 41 can be dispensed with, which contributes to simplification of the arrangement.

Furthermore, the interval between the marks 40 and that between the scanning lines of the electrostatic latent image are held substantially constant even when the rotational speed of the photosensitive drum 1 changes, which reduces disturbance in control executed so as to cause the marks 41 and 40 to match with each other. This makes it possible to obtain higher-accuracy image geometric characteristics, which is advantageous in reduction of image expansion or contraction.

Although in the present embodiment, the scanning lines of an electrostatic latent image are formed in synchronism of detection of the respective marks 40, it is not absolutely necessary to use the same frequency. For example, an electrostatic latent image different in scanning frequency (interval) from that of the marks 40 may be formed by dividing or multiplying the frequency of an output signal from the mark reading device 55.

As for the method of correcting a difference between the second timing and the first timing, the method using the detection sections 70 to 73, which is employed in the first and third embodiments, may be employed in the second embodiment. Conversely, the method using the mark reading device 43K and the sheet position-detecting section 77, which is employed in the second embodiment, may be employed in the first and third embodiments.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2012-222204 filed Oct. 4, 2012, and Japanese Patent Application No. 2013-190627 filed Sep. 13, 2013, which are hereby incorporated by reference herein in their entirety.

What is claimed is:

1. An image forming apparatus comprising:

an image bearing member;

an image forming unit configured to form a toner image on said image bearing member;

an intermediate transfer member onto which the toner image formed on said image bearing member by said image forming unit is transferred;

a driving unit configured to drive said intermediate transfer member to convey the toner image transferred onto said intermediate transfer member;

a transfer unit configured to transfer the toner image on said intermediate transfer member, which has been conveyed to a transfer position by said driving unit, onto a sheet;

a conveying unit configured to convey the sheet to the transfer position;

a first detection unit configured to detect an image indicating a position of the toner image on said intermediate transfer member;

a second detection unit configured to detect that the sheet conveyed by said conveying unit has reached a detection position upstream of the transfer position in a direction in which the sheet is conveyed by said conveying unit; and a control unit configured to control a conveying speed of said intermediate transfer member, based on timing of detection by said first detection unit and timing of detection by said second detection unit, such that the toner image on said intermediate transfer member is transferred by said transfer unit onto a predetermined position on the sheet conveyed by said conveying unit, wherein said control unit controls, based on the timing of detection by said first detection unit and the timing of detection by said second detection unit, the conveying speed of said intermediate transfer member during a time period from a time point when the image is detected by said first detection unit to a time point when the sheet conveyed by said conveying unit reaches the transfer position.

2. The image forming apparatus according to claim 1, wherein said control unit controls the conveying speed of said intermediate transfer member, based on a difference between the timing of detection by said first detection unit and the timing of detection by said second detection unit.

3. The image forming apparatus according to claim 1, further comprising another driving unit configured to drivingly rotate said image bearing member; and another control unit configured to control a rotational speed of said image bearing member in synchronism with control of the conveying speed of said intermediate transfer member by said control unit.

4. The image forming apparatus according to claim 3, wherein said image forming unit includes an exposure unit configured to expose said image bearing member having a photosensitive member, and controls timing of exposure by said exposure unit for formation of a toner image on said image bearing member by said image forming unit in synchronism with control of the rotational speed of said image bearing member by said another driving unit.

5. The image forming apparatus according to claim 1, further comprising a roller around which said intermediate transfer member is wound, and said intermediate transfer member having a belt-like shape, said roller being driven for rotation by said driving unit, and wherein said control unit controls a rotational speed of said roller by said driving unit.

6. An image forming apparatus comprising:

an image bearing member;

an image forming unit configured to form a toner image on said image bearing member;

an intermediate transfer member onto which the toner image formed on said image bearing member by said image forming unit is transferred;

a driving unit configured to drive said intermediate transfer member to convey the toner image transferred onto said intermediate transfer member;

a transfer unit configured to transfer the toner image on said intermediate transfer member, which has been conveyed to a transfer position by said driving unit, onto a sheet;

a conveying unit configured to convey the sheet to the transfer position;

a first detection unit configured to detect an image indicating a position of the toner image on said intermediate transfer member;

a second detection unit configured to detect that the sheet conveyed by said conveying unit has reached a detection position upstream of the transfer position in a direction in which the sheet is conveyed by said conveying unit; and a control unit configured to control a conveying speed of said intermediate transfer member, based on timing of detection by said first detection unit and timing of detection by said second detection unit, such that the toner image on said intermediate transfer member is transferred by said transfer unit onto a predetermined position on the sheet conveyed by said conveying unit, wherein said conveying unit conveys a sheet at a predetermined speed, and wherein said control unit controls the conveying speed of said intermediate transfer member based on the timing of detection by said first detection unit and the timing of detection by said second detection unit, and thereafter controls the conveying speed of said intermediate transfer member to the predetermined speed before the sheet conveyed by said conveying unit reaches the transfer position.

7. An image forming apparatus comprising:

an image bearing member;

an image forming unit configured to form a toner image on said image bearing member;

an intermediate transfer member onto which the toner image formed on said image bearing member by said image forming unit is transferred;

a driving unit configured to drive said intermediate transfer member to convey the toner image transferred onto said intermediate transfer member;

a transfer unit configured to transfer the toner image on said intermediate transfer member, which has been conveyed to a transfer position by said driving unit, onto a sheet;

a conveying unit configured to convey the sheet to the transfer position;

a first detection unit configured to detect an image indicating a position of the toner image on said intermediate transfer member;

a second detection unit configured to detect that the sheet conveyed by said conveying unit has reached a detection position upstream of the transfer position in a direction in which the sheet is conveyed by said conveying unit; and a control unit configured to control a conveying speed of said intermediate transfer member, based on timing of detection by said first detection unit and timing of detection by said second detection unit, such that the toner image on said intermediate transfer member is transferred by said transfer unit onto a predetermined position on the sheet conveyed by said conveying unit, wherein said control unit includes a determination unit configured to determine, based on the timing of detection by said first detection unit and the timing of detection by said second detection unit, the conveying speed of said intermediate transfer member, and wherein said control unit controls said driving unit such that the conveying speed of said intermediate transfer member during the time period from the time point when the image is detected by said first detection unit to the time point when the sheet conveyed by said conveying unit reaches the transfer position becomes equal to the conveying speed determined by said determination unit.

8. An image forming apparatus comprising:

an image bearing member;

an image forming unit configured to form a toner image on said image bearing member;

an intermediate transfer member onto which the toner image formed on said image bearing member by said image forming unit is transferred;

a driving unit configured to drive said intermediate transfer member to convey the toner image transferred onto said intermediate transfer member;

a transfer unit configured to transfer the toner image on said intermediate transfer member, which has been conveyed to a transfer position by said driving unit, onto a sheet;

a conveying unit configured to convey the sheet to the transfer position;

a first detection unit configured to detect an image indicating a position of the toner image on said intermediate transfer member;

a second detection unit configured to detect that the sheet conveyed by said conveying unit has reached a detection position upstream of the transfer position in a direction in which the sheet is conveyed by said conveying unit;

a control unit configured to control a conveying speed of said intermediate transfer member, based on timing of detection by said first detection unit and timing of detection by said second detection unit, such that the toner image on said intermediate transfer member is transferred by said transfer unit onto a predetermined position on the sheet conveyed by said conveying unit;

another image bearing member located downstream of said image bearing member in the direction in which said intermediate transfer member is conveyed;

another image forming unit configured to form a toner image on said another image bearing member;

a first mark forming unit configured to form first marks on said image bearing member along a direction in which said image bearing member rotates;

a second mark forming unit configured to form second marks on said another image bearing member along a direction in which said another image bearing member rotates;

a first mark reading unit configured to read the first marks formed on said image bearing member by said first mark forming unit;

a second mark reading unit configured to read the second marks formed on said another image bearing member by said second mark forming unit;

a third mark forming unit configured to form third marks on said intermediate transfer member along a direction in which said intermediate transfer member conveys a toner image, in response to reading of the respective first marks by said first mark reading unit;

a third mark reading unit configured to read the third marks formed on said intermediate transfer member by said third mark forming unit; and another control unit configured to control driving of said another image bearing member such that timing at which each second mark is read by said second mark reading unit and timing at which each third mark is read by said third mark reading unit is coincident with each other.

9. An image forming apparatus comprising:

an image bearing member;

a first driving unit configure to drivingly rotate said image bearing member;

an image forming unit configured to form a toner image on said image bearing member;

an intermediate transfer member onto which the toner image formed on said image bearing member by said image forming unit is transferred;

a second driving unit configured to drive said intermediate transfer member;

a transfer unit configured to transfer the toner image on said intermediate transfer member onto a sheet at a transfer position;

a conveying unit configured to convey the sheet to the transfer position;

a first detection unit configured to detect an image indicating a position of the toner image on said intermediate transfer member;

a second detection unit configured to detect that the sheet conveyed by said conveying unit has reached a detection position upstream of the transfer position in a direction in which a sheet is conveyed by said conveying unit;

a determination unit configured to determine, based on timing of detection by said first detection unit and timing of detection by said second detection unit, the conveying speed of said intermediate transfer member; and a control unit configured to control said first driving unit and said second driving unit such that the conveying speed of said intermediate transfer member during a time period from a time point when the image is detected by said first detection unit to a time point when the sheet conveyed by said conveying unit reaches the transfer position becomes equal to the conveying speed determined by said determination unit.

* * * * *